US009932981B2

(12) United States Patent
Cosgrove et al.

(10) Patent No.: US 9,932,981 B2
(45) Date of Patent: Apr. 3, 2018

(54) WATERPROOF PUMP ENCLOSURE AND SYSTEM INCLUDING SAME

(71) Applicant: Preferred Utilities Manufacturing Corporation, Danbury, CT (US)

(72) Inventors: Dennis W. Cosgrove, Bethel, CT (US); David G. Eoff, Carrollton, TX (US); Salvatore A. Mola, Sandy Hook, CT (US)

(73) Assignee: Preferred Utilities Manufacturing Corporation, Danbury, CT (US)

( * ) Notice: Subject to any disclaimer, the term of this patent is extended or adjusted under 35 U.S.C. 154(b) by 312 days.

(21) Appl. No.: 14/633,364

(22) Filed: Feb. 27, 2015

(65) Prior Publication Data

US 2015/0247497 A1 Sep. 3, 2015

Related U.S. Application Data

(60) Provisional application No. 61/947,059, filed on Mar. 3, 2014.

(51) Int. Cl.
*F04C 13/00* (2006.01)
*F04D 29/40* (2006.01)
(Continued)

(52) U.S. Cl.
CPC ..... *F04C 13/002* (2013.01); *F01C 21/007* (2013.01); *F04B 15/02* (2013.01);
(Continued)

(58) Field of Classification Search
CPC ..... F04B 17/006; F04B 23/00; F04B 23/02; F04B 23/021; F04B 7/0096; F04B 15/00; F04B 15/02; F04B 17/03; F04B 17/06; F04B 19/04; F04B 53/16; F04B 47/06; F04D 13/06; F04D 13/068; F04D 13/08; F04D 13/086; F04D 29/40; F04D 29/406; F04C 2/10; F04C 11/008; F04C 13/001;
(Continued)

(56) References Cited

U.S. PATENT DOCUMENTS 3,837,766 A * 9/1974 Cook ..... F04D 29/086 415/175
3,994,624 A * 11/1976 Plunkett ..... E03B 5/025 138/30
(Continued)

FOREIGN PATENT DOCUMENTS

DE 2433802 A1 * 1/1976 ..... F04B 17/03

*Primary Examiner* — Patrick Hamo
*Assistant Examiner* — Chirag Jariwala
(74) *Attorney, Agent, or Firm* — Jianhui Hong

(57) ABSTRACT

The present invention is directed to a pump and motor assembly assembled in a waterproof enclosure with external threaded connections for pump suction and discharge. The motor can be directly connected to a flexible coupling to a bi-rotational internal gear pump, having self-adjusting mechanical seals and cast iron housing. The pump and motor assembly can be mounted on a sliding base for easy access. Flex hoses can be used to connect pump suction and discharge to couplings attached to the pump enclosure. A discriminating leak detector can be installed at the low point of the pump enclosure to detect and annunciate the presence of oil and/or water.

13 Claims, 35 Drawing Sheets

(51) Int. Cl.

| | |
|---|---|
| ***F04B 19/04*** | (2006.01) |
| ***F01C 21/00*** | (2006.01) |
| ***F04B 15/02*** | (2006.01) |
| ***F04C 2/10*** | (2006.01) |
| ***F04B 23/02*** | (2006.01) |
| ***F04B 47/06*** | (2006.01) |

(52) U.S. Cl.
CPC ..... *F04B 19/04* (2013.01); *F04B 23/021* (2013.01); *F04B 47/06* (2013.01); *F04C 2/10* (2013.01); *F04C 13/008* (2013.01); *F04D 29/406* (2013.01); *F04C 2210/1044* (2013.01)

(58) Field of Classification Search
CPC .. F04C 13/002; F04C 13/008; F04C 2210/10; F04C 2210/1044; F04C 2210/20; F04C 2210/203; F04C 2240/30; F01C 21/007
USPC ..... 417/423.3, 902
See application file for complete search history.

(56) References Cited

U.S. PATENT DOCUMENTS

| | | | | | |
|---|---|---|---|---|---|
| 4,248,258 | A * | 2/1981 | Devitt | E04D 13/0404 | 137/124 |
| 5,330,104 | A * | 7/1994 | Marcus | F24F 6/14 | 239/266 |
| 5,924,846 | A * | 7/1999 | Arnold, Jr. | E02D 29/14 | 404/25 |
| 6,189,811 | B1 * | 2/2001 | Rudy | F04B 17/006 | 239/375 |
| 2011/0064592 | A1 * | 3/2011 | Jaeschke | F04C 11/008 | 417/360 |
| 2014/0231328 | A1 * | 8/2014 | Sheehy | E03B 3/02 | 210/191 |
| 2015/0110642 | A1 * | 4/2015 | Dahouk | F04D 13/068 | 417/16 |
| 2016/0245245 | A1 * | 8/2016 | Volker | F04B 17/03 | |

* cited by examiner

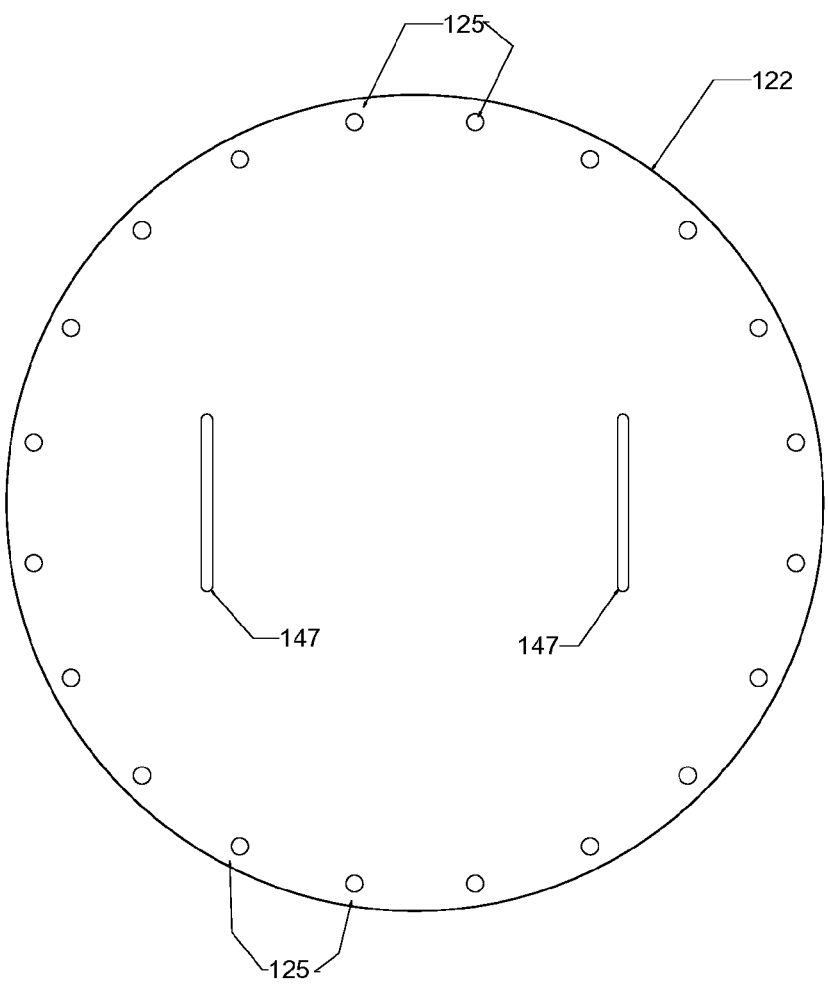
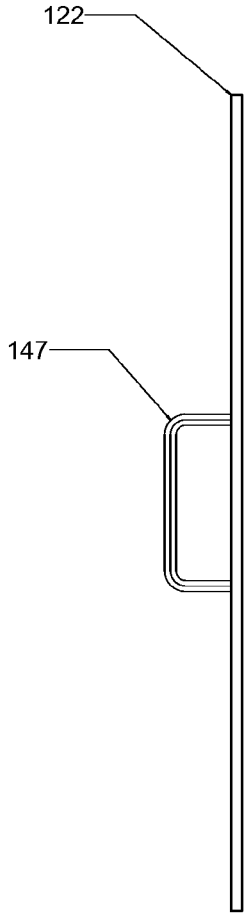
FIG. 9B
FIG. 9A

FIG. 14C
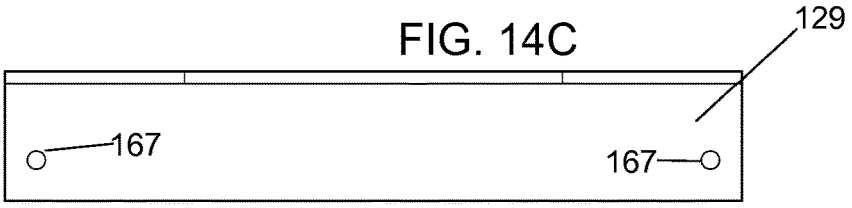
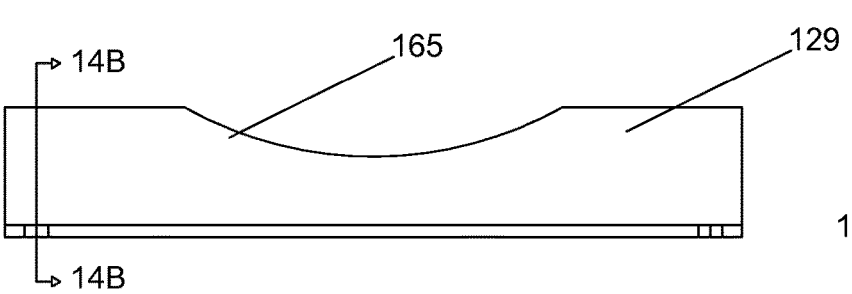
FIG. 14A
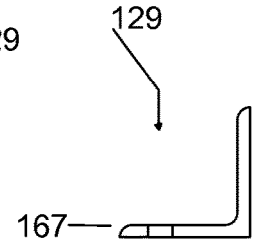
FIG. 14B

FIG. 23B
FIG. 23A
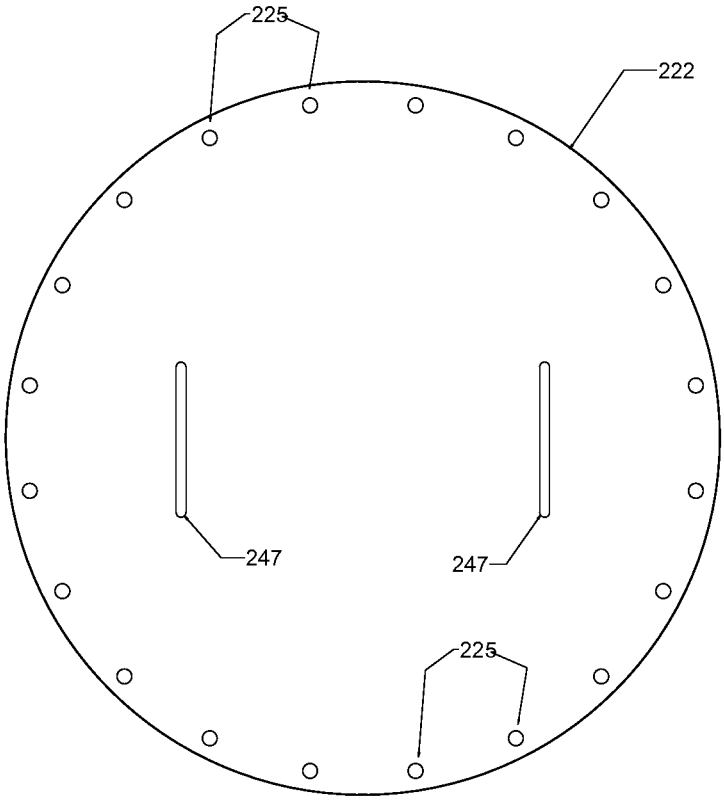
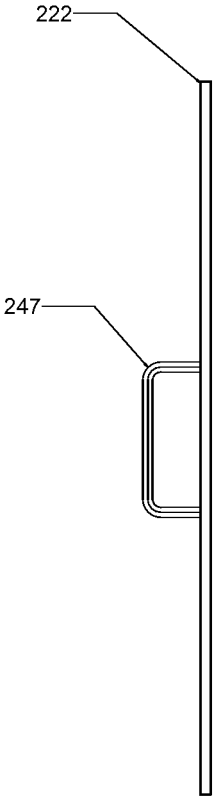

WATERPROOF PUMP ENCLOSURE AND SYSTEM INCLUDING SAME

CROSS-REFERENCE TO RELATED APPLICATIONS

This application claims priority to U.S. Provisional Appl. No. 61/947,059 filed Mar. 3, 2014, which is hereby incorporated by reference in its entirety.

BACKGROUND OF THE INVENTION

1. Field of the Invention

The present invention generally relates to waterproof pump enclosures, and more particularly to a waterproof pump enclosure and system including the same for pumping fuel oil from below history flood levels.

2. Description of Related Art

When Hurricane Sandy hit New York City in October 2012 many of the basements in lower Manhattan were flooded by seawater. New York City basements typically house the boilers, emergency generators, and their diesel fueling systems. Most of the hospitals in Manhattan lost grid power, lost emergency back-up power, and had to be evacuated. For example, Bellevue Hospital had emergency generators above the Sandy flood line, but the fueling system for the generators was in the basement and was incapacitated by flooding.

One option for overcoming these difficulties is to install new pumps above the flood line, but this solution is not practical for all locations. For example, in New York City most of the oil tanks are in the basements of the buildings, and there is not sufficient room to relocate the tanks to location on or within the buildings that would be above the flood line. Pumps cannot be elevated without raising the tanks because positive displacement gear pumps are limited by the amount of suction they can generate to pull oil out of tanks. Positive displacement pumps can generally only pull oil up 12-15 feet. Furthermore, alternatives, such as submersible pumps located in the oil tanks may not be approved for use in all locations.

In addition, there are also problems associated with a system in which submersible pumps are used to pump oil out of the tanks to positive displacement pumps that would supply enough pressure to push oil up many stories to where boilers and diesel generators are sometimes located. Submersible pumps also do not generate enough head pressure to push oil above two or three stories. Additionally, submersible pump-positive displacement pump systems are difficult to control, risk over-pressuring the inlet of the positive displacement pumps, and are at increased risk of causing a fuel oil spill.

Therefore, what is needed is a means for installing positive displacement pumps in their usual location in the basements at the same level as the oil tanks to prevent suction lift problems, and then having pump accessories such as gauges, pressure relief valves, flow switches, and pump controls could be located above the flood level.

SUMMARY OF THE INVENTION

The present invention is designed to overcome the above noted limitations that are attendant upon the use of conventional pumps and, toward this end, it contemplates the provision of a novel waterproof pump enclosure and system including the same.

It is an object of the present invention to provide a positive displacement fuel oil pump in a waterproof enclosure.

It is a further object of the present invention to provide a discriminating leak detector to indicate the presence of oil or water in the interior of the enclosure.

It is another object of the present invention to provide flexible stainless steel hoses with unions to connect the supply and suction sides of the pump to waterproof bulkhead fittings welded to the pump enclosure.

It is yet another object of the present invention to provide a sliding tray to allow the oil pump and motor to be slid partially out of the enclosure for maintenance.

It is still another object of the present invention to provide waterproof conduit connections for the pump motor leads and the leak detector wires.

It is yet another object of the present invention to provide a heavy duty gasketed manhole cover to provide a waterproof seal when tightened down, and access to the interior of the pump enclosure when opened up.

It is still another object of the present invention to provide a pump enclosure for applications were fuel oil pumps cannot be installed above historic flood levels due to suction lift constraints.

It is a further object of the present invention to provide a pump enclosure that is designed to withstand seawater inundation, and continue supplying fuel, for example diesel fuel, to critical generators and boilers.

It is yet another object of the present invention to provide a pump enclosure that shows only negligible temperature rise inside the enclosure when the pumps are under load.

It is still another object of the present invention to provide a pump enclosure that allows for pump accessories, such as pump control panels, motor starters, strainers, gauges and switches.

It has now been found that the foregoing and related objects can be readily attained in an oil pump and motor assembly assembled in an epoxy enamel-coated carbon steel waterproof enclosure with external threaded connections for pump suction and discharge. The base-mounted motor can be directly connected to a flexible coupling to a bi-rotational internal gear pump, having self-adjusting mechanical seals and cast iron housing. The pump and motor assembly can be mounted on a sliding steel base for easy access. Stainless steel flex hoses can be used to connect pump suction and discharge to coupling welded to the pump enclosure. A discriminating leak detector can be installed at the low point of the pump enclosure to detect and annunciate the presence of oil and/or water. Electrical connections can include sealed conduit and wire pigtails for termination above expected high water and/or flood levels. Pump and motor assemblies can be any suitable pump and motor assemblies available from Preferred Utilities Manufacturing Corp. of Danbury, Conn. that are suitable for No. 2 fuel oil, No. 4 fuel oil and or diesel fuel.

The pump enclosures may be installed in any building, for example high rise buildings, that are located in low-lying areas and/or areas prone to flooding. Such buildings may include hospitals, government buildings, and private buildings housing financial, high-tech, or other critical systems that typically have emergency diesel generators, but require fuel for the generators to run.

BRIEF DESCRIPTION OF THE SEVERAL VIEWS OF THE DRAWINGS

For a fuller understanding of the nature and object of the present invention, reference should be had to the following detailed description taken in connection with the accompanying drawings, in which:

FIG. 9A is a front view of a cover assembly for the waterproof pump enclosure according to the present invention;

FIG. 9B is a side view of the cover assembly for the waterproof pump enclosure according to the present invention;

FIG. 14A is a front view of an exemplary mounting bracket for the waterproof pump enclosure according to the present invention;

FIG. 14B is a cross-sectional view taken along line 14B-14B in FIG. 14A of the exemplary mounting bracket for the waterproof pump enclosure according to the present invention;

FIG. 14C is a top plan view of the exemplary mounting bracket for the waterproof pump enclosure according to the present invention;

FIG. 23A is a front view of a cover assembly for the waterproof pump enclosure according to the present invention;

FIG. 23B is a side view of the cover assembly for the waterproof pump enclosure according to the present invention;

DETAILED DESCRIPTION OF THE INVENTION

Figure 1:
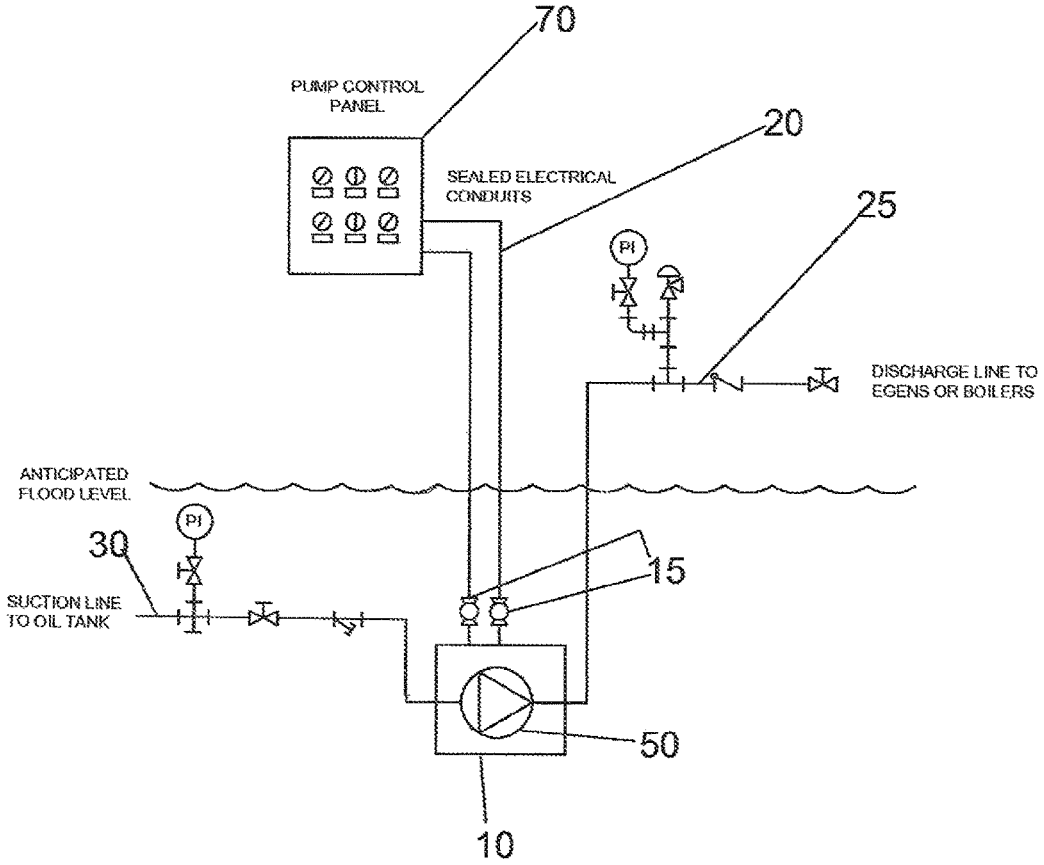
FIG. 1 is a schematic view of an exemplary system in which an exemplary embodiment of a waterproof pump enclosure according to the present invention may be used.

The present invention now will be described more fully hereinafter with reference to the accompanying figures, in which exemplary embodiments of the invention are shown. The invention may, however, be embodied in many different forms and should not be construed as limited to the embodiments set forth herein. Like reference numerals refer to like elements throughout.

Referring now to FIG. 1, a general schematic diagram of a system in which a pump enclosure 10 according to the present invention may be employed is shown. The pump enclosure 10 may contain a suitable pump 50, for example a light oil pump, and the pump enclosure 10 may be constructed to be substantially waterproof so that the pump enclosure 10 may be installed in a building (not shown) below the anticipated flood level. The pump enclosure 10 is connected by a suction line 30 to a tank (not shown), for example an oil tank, containing the fluid to be transported by the pump 50, and is further connected to generators (not shown), for example emergency backup generators, and/or boilers (not shown), for example heating boilers, by a discharge line 25 so that the fluid to be transported, for example oil, can be transported by the pump 50 from the tank positioned above the anticipated flood level of the building to the generators and/or boilers positioned above the anticipated flood level of the building. The pump enclosure 10 may also be connected to a pump control panel 70 by one or more sealed electrical conduits 20 that are coupled to the pump enclosure 10 by one or more potting eyes 15 to provide for a watertight connection between the electrical conduits 20 and the pump enclosure 10.

Figures 2, 3:
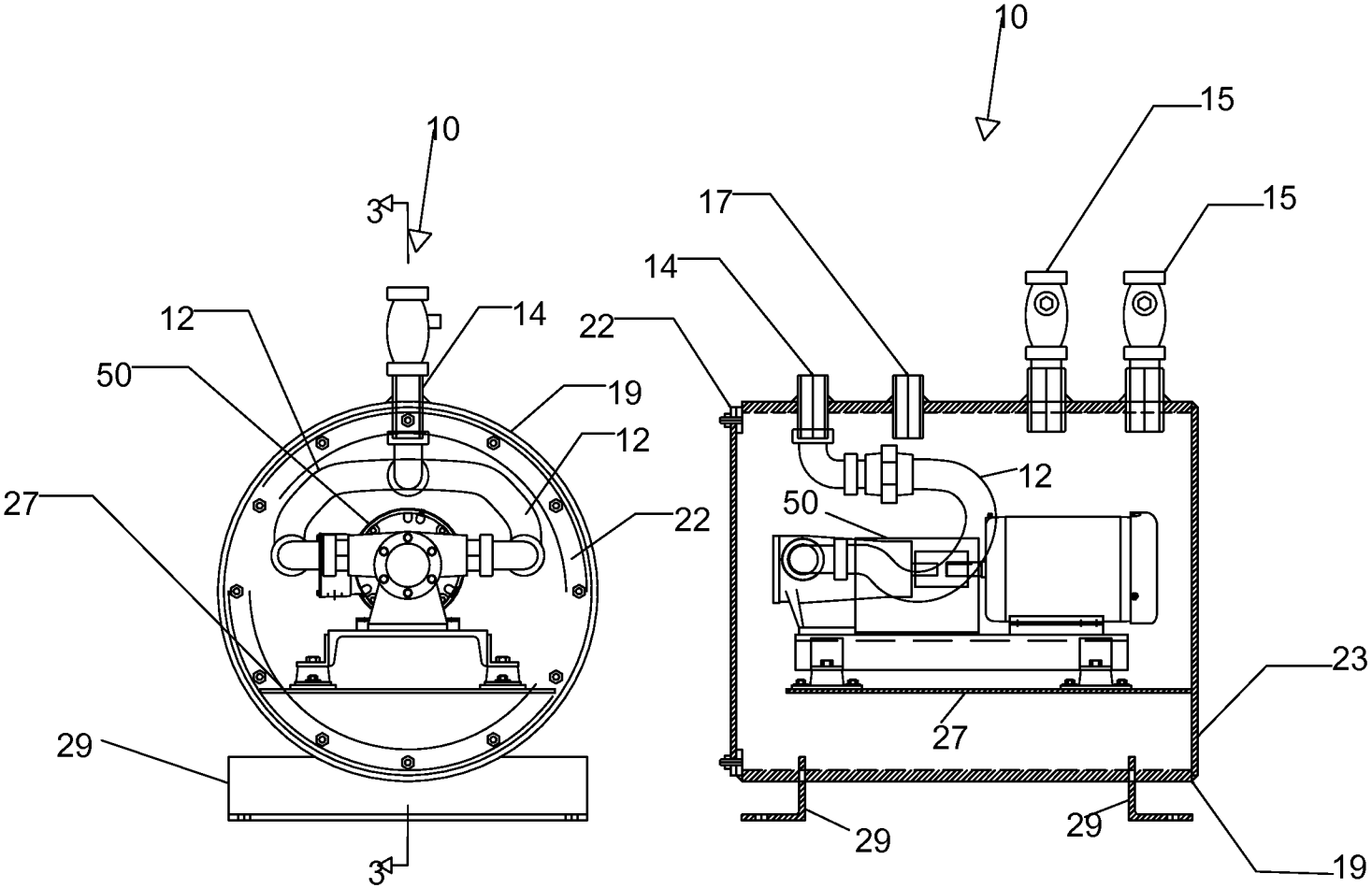
FIG. 2 is a front view of an exemplary embodiment of a waterproof pump enclosure according to the present invention.
FIG. 3 is a cross-sectional view taken along line 3-3 in FIG. 2 of the waterproof pump enclosure according to the present invention.

Referring now to FIGS. 2 and 3, therein illustrated is an exemplary embodiment of the pump enclosure, generally indicated by reference numeral 10, according to the present invention. The pump enclosure 10 includes a substantially cylindrical body pipe 19 that forms a hollow enclosure. The body pipe 19 may be formed from Schedule 40 pipe, or any other suitable substantially cylindrical material. The pump enclosure 10 further includes a cover plate 22 that may be removably affixed to the body pipe 19, and a back plate 23 that may be welded to the body pipe 19. It is understood that the cover plate 22 and the back plate 23 should be attached to the body pipe 19 so as to provide a substantially watertight hollow enclosure of the pump enclosure 10 for housing the pump 50. The pump 50 may be supported within the hollow enclosure of the body pipe 19 by a mounting plate 27, to which the pump 50 may be secured by one or more fasteners. The pump enclosure 10 may also include a supply inlet 14 that may be connected to a line from a tank (not shown in FIGS. 2 & 3), and to a flexible hose 12 that is connected to the pump 50. The pump enclosure 10 may further include a discharge outlet 17 that is connected to a discharge line (not shown) connected to a generator and/or boiler and a flexible hose 12 (in FIG. 2) that is connected to the pump 50. The supply inlet 14 and discharge outlet 17 provide for passageways through the body pipe 19, but provide for watertight connections between the lines running to the pump enclosure 10 and the flexible hoses 12 within the pump enclosure 10 connected to the pump 50. The pump enclosure 10 may also include one or more potting eyes 15 that provide for connection between the pump enclosure 10 and electrical wiring (not shown in FIGS. 2 and 3) running to the pump control panel (not shown in FIGS. 2 and 3) that may be positioned above the anticipated flood level of a building. The pump enclosure 10 may also include one or more mounting brackets 29 for securing mounting the pump enclosure 10 to a surface (not shown) by either welding and/or mechanical fasteners (not shown). It is understood that the pump enclosure 10 should be securely mounted to the surface so that in the event that the area surrounding the pump enclosure is inundated with water, the force of the water will not cause the pump enclosure 10 to move from its fixed position within the building.

Figure 16:
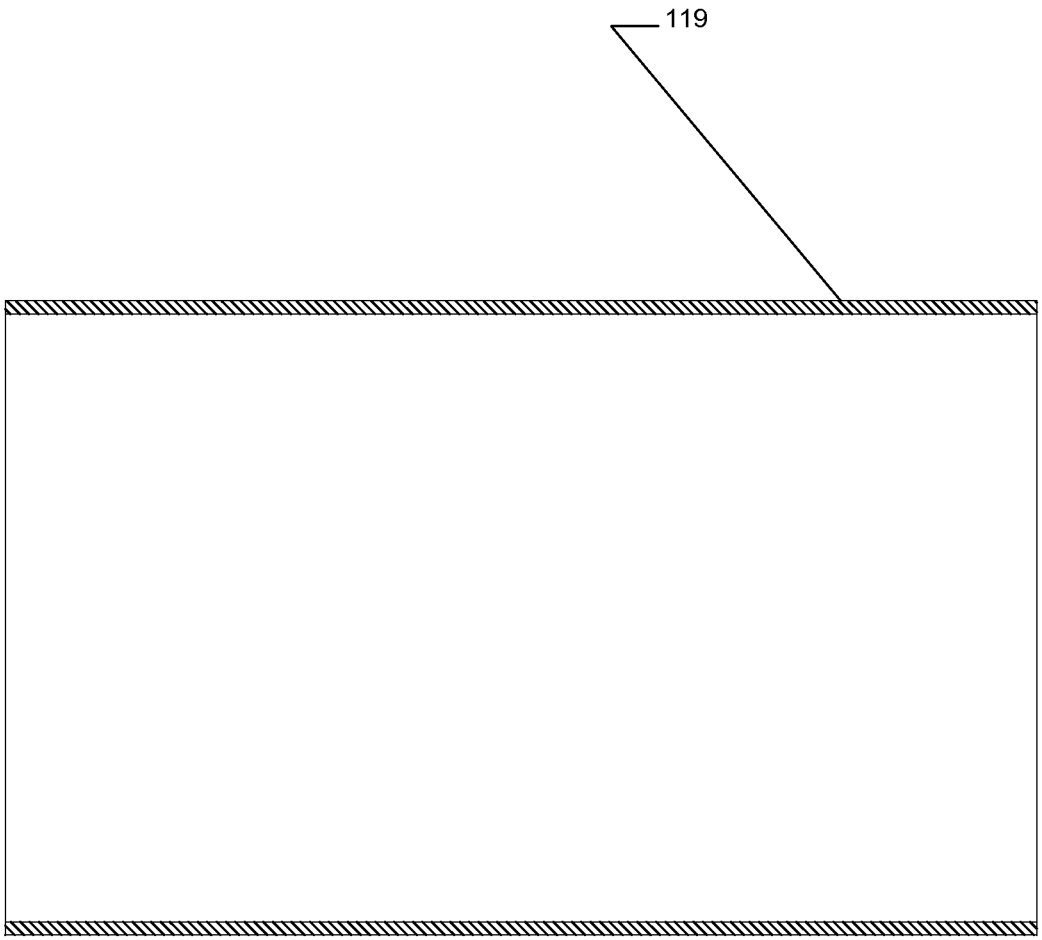
FIG. 16 is a cross-sectional view of an exemplary body pipe for the waterproof pump enclosure according to the present invention.
Figure 17B:
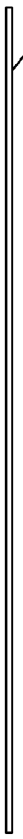
FIG. 17B is a side view of the exemplary flange gasket for the waterproof pump enclosure according to the present invention.
Figure 17A:
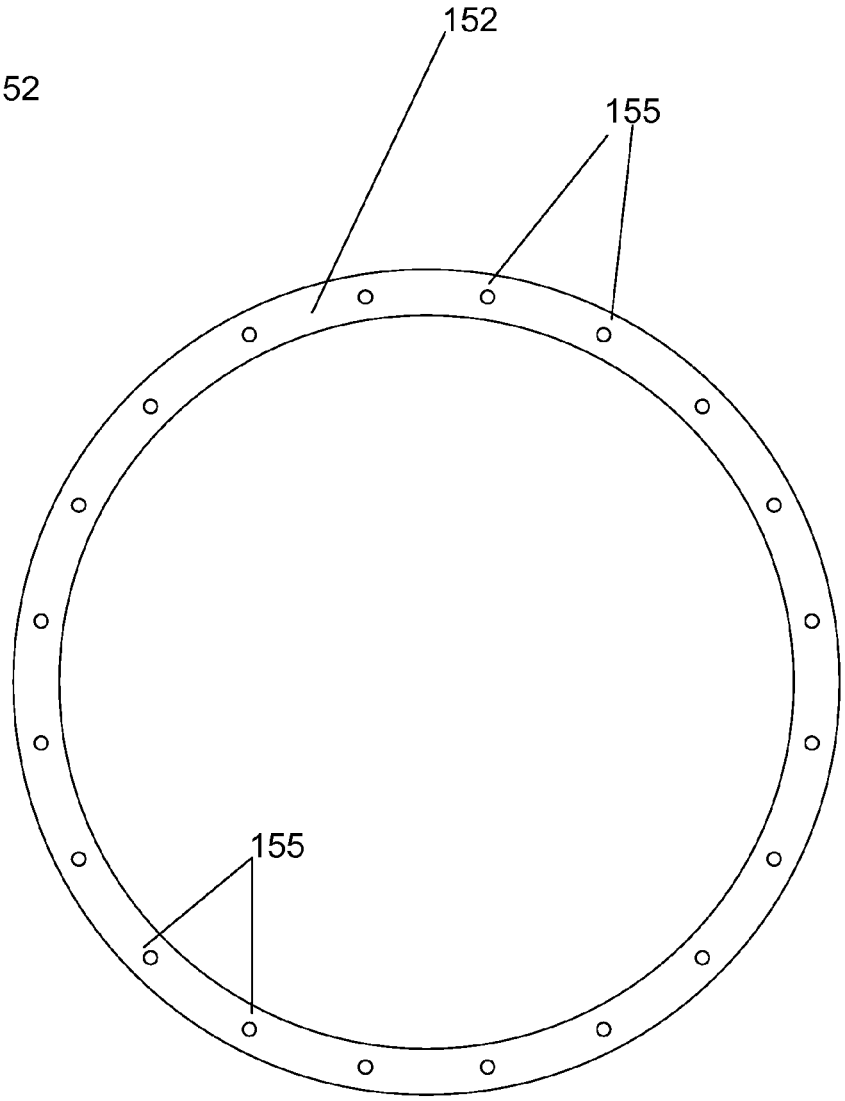
FIG. 17A is a front view of an exemplary flange gasket for the waterproof pump enclosure according to the present invention.

Referring now to FIGS. 4-8, another exemplary embodiment of a pump enclosure, generally indicated by reference numeral 110, according to the present invention is shown. The pump enclosure 110 may include a substantially circular body pipe 119 that may be formed from epoxy-enamel painted carbon steel to form a hollow enclosure. The exemplary body pipe 119 that may be used with the pump enclosure 110 is shown by itself in FIG. 16.

Figure 12A:
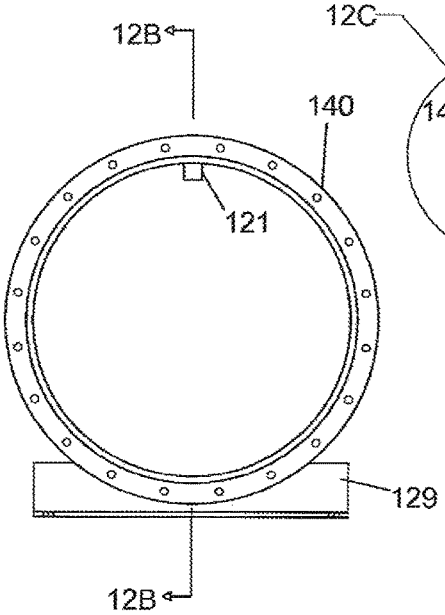
FIG. 12A is a front view of the waterproof pump enclosure with the cover assembly removed and without internal components.
Figure 12B:
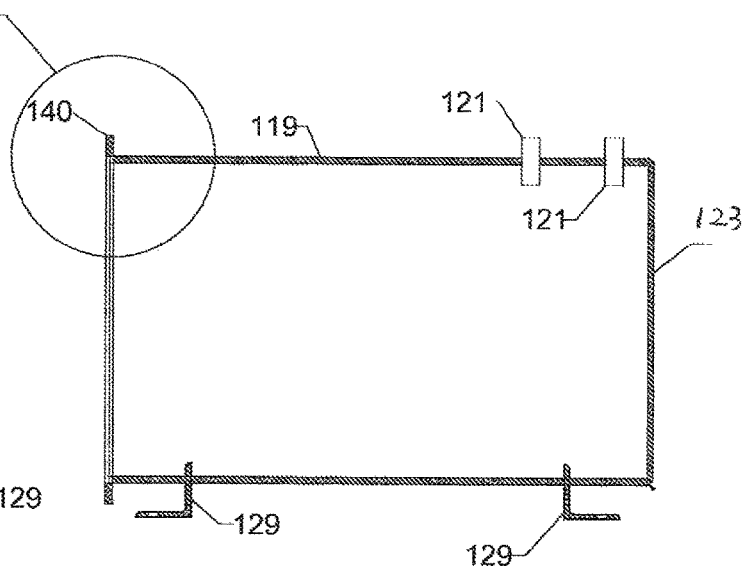
FIG. 12B is a cross-sectional view taken along line 12B-12B in FIG. 12A.
Figure 12C:
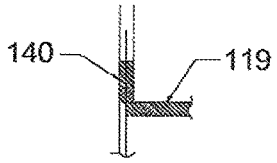
FIG. 12C is an enlarged view of Section 12C from FIG. 12B.
Figure 13A:
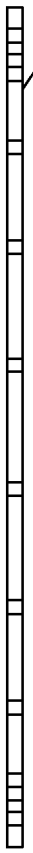
FIG. 13A is a front view of an exemplary flange for the waterproof pump enclosure according to the present invention.
Figure 13B:
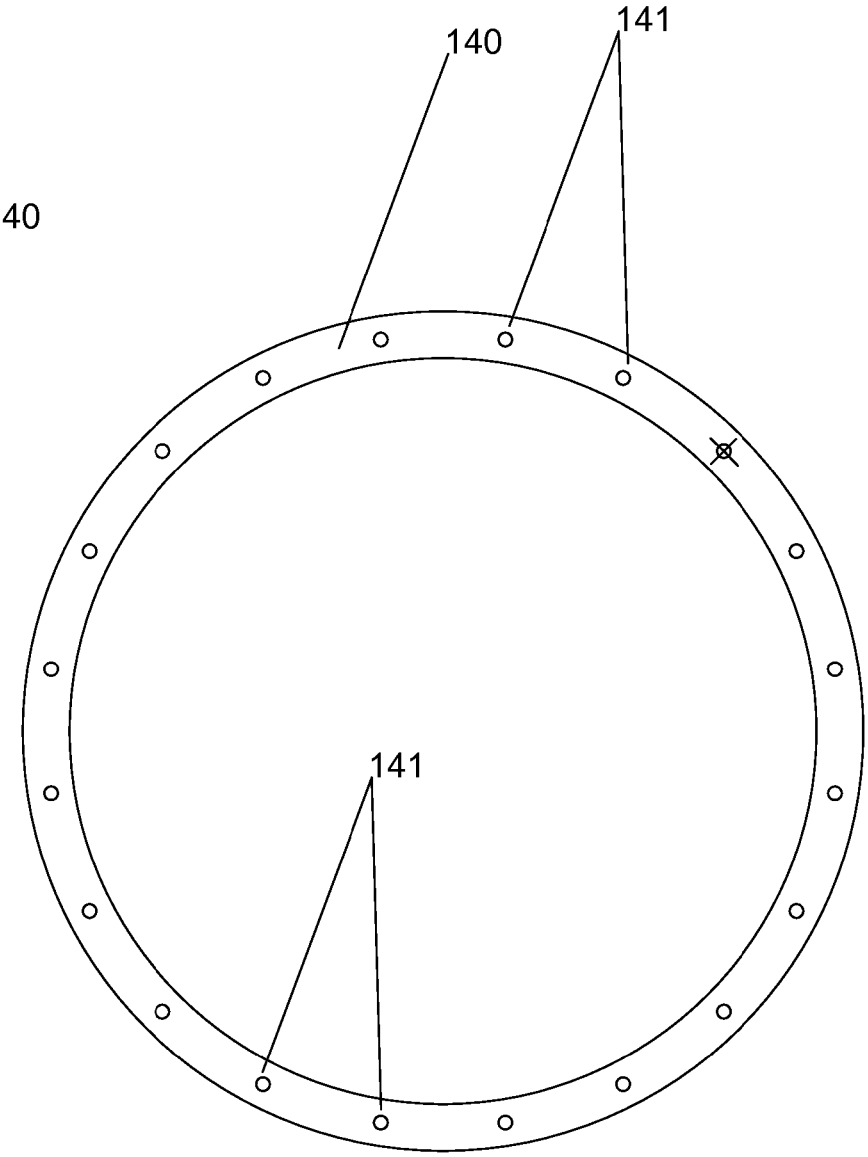
FIG. 13B is a side view of the exemplary flange for the waterproof pump enclosure according to the present invention.

Referring now to FIGS. 4-8, 12A-12C and 13A-13B, the pump enclosure 110 may also include a flange 140 formed on one end of the body pipe 119. As shown by FIGS. 12A and 12C, the flange 140 may be positioned substantially perpendicular to the body pipe 119 so that the flange 140 provides a mounting surface for the body pipe 119. The flange 140 may be integrally formed with the body pipe 119, or constructed of a separate component, for example as shown in FIGS. 13A and 13B, and affixed to the body pipe 119 through suitable welding and/or adhesive. As shown in FIG. 13B, the flange 140 includes a plurality of bores 141 formed there through and positioned around the circumference of the flange 140. The bores 141 may be positioned in any pattern or formation around the flange 140, and it may be preferable that the bores 141 are positioned so that any fastening device as discussed below used on the flange 140 provides a substantially equal clamping pressure around the circumference of the flange 140.

Referring now to FIGS. 4-8, 9A-9B and 17A-17B, the pump enclosure 110 may also include a cover plate 122 that is configured to be secured to the flange 140 by one or more suitable fasteners, such as a bolt 153 and nut 154 combination. It is understood that any suitable fastener may be used to secure the cover plate 122 to the flange 140, but it is preferable that the fasteners are capable of releasing the cover plate 122 from the flange 140 through appropriate removable mechanisms and/or tools so that access to the interior of the pump enclosure 110 can be gained without substantial effort or difficulty. While a bolt 153 and nut 154 combination is provided as an example of a suitable fastener, it is understood that such combination is merely exemplary and that the fasteners may also include screws that engage with threads within the bores 141 of the flange 140. A gasket 152, as shown in greater detail in FIGS. 17A-17B, for example a gasket made from neoprene rubber, may be placed between the cover plate 122 and flange 140 so as to provide a water tight connection between the cover plate 122 and the flange 140 so as to seal the pump enclosure 110. The gasket 152 may include one or more bores 155 positioned around the circumference of the gasket 152 so that the fasteners 153, 154 may be inserted through the cover plate 122, gasket 152 and flange 140. Preferably, the bores 155 formed through the gasket 152 are positioned for alignment with the bores 141 formed in the flange 140 and preferably the same number of bores 141 formed in the flange 140 are present in the gasket 152. However, it is understood that additional bores 155 may be formed in the gasket 152 than those formed in the flange 140 so that alignment and installation of the gasket 152 on the flange 140 may be facilitated. Referring now more particularly to FIGS. 9A and 9B, cover plate 122 may include one or more handles 147 to facilitate removal and installation of the cover plate 122, and may also include one or more bores 125 positioned around the circumference of the cover plate 122 so that the fasteners 153, 154 may be inserted through the cover plate 122, gasket 153 and flange 140. The handles 147 may be formed from substantially U-shaped or C-shaped rod or bar, and securely affixed to the cover plate 122. The one or more bores 125 are positioned around the cover plate 122 so that when the cover plate 122 is applied to the flange 140 the bores 141 on the flange 140 substantially align with the bores 125 on the cover plate 122 so that the fasteners 153, 154 can secure the cover plate 122 to the flange 140. It is understood that the bores 125 on the cover plate 122 may be the same number as the bores 141 on the flange 140 or may be greater or lesser in number depending upon the desired application.

Figures 15A, 15B:
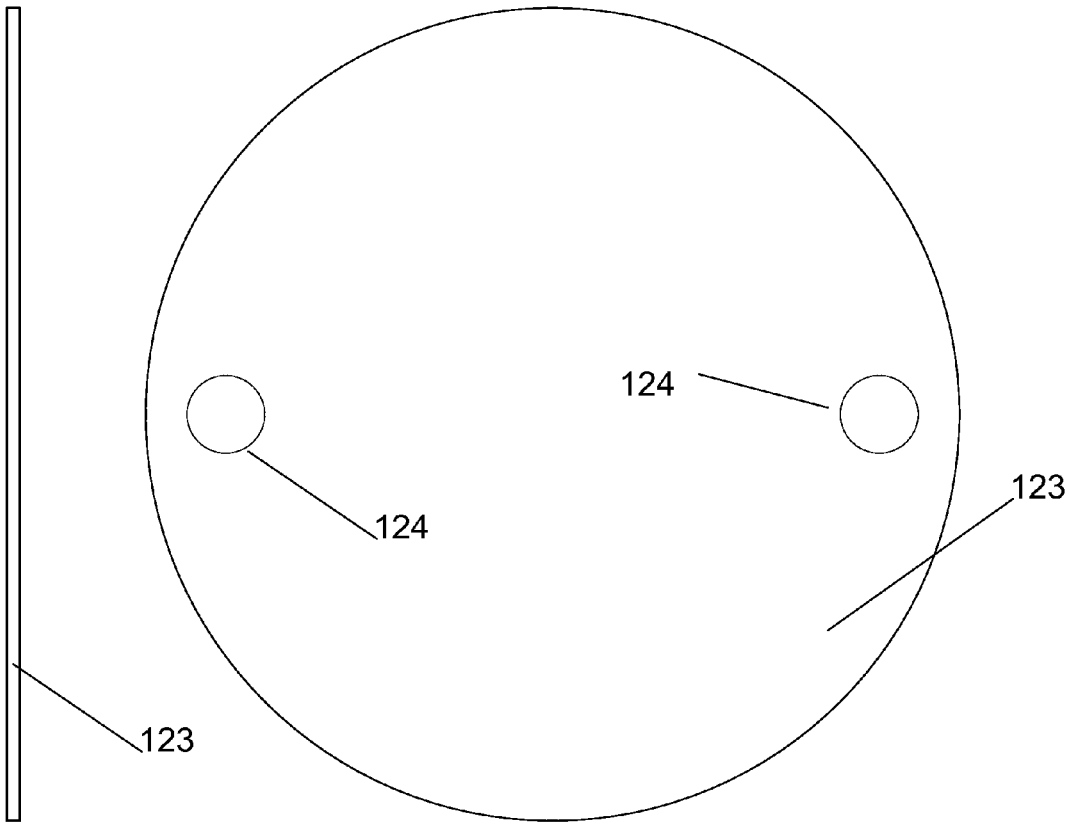
FIG. 15A is a front view of an exemplary back cover plate for the waterproof pump enclosure according to the present invention.
FIG. 15B is a side view of the exemplary back cover plate for the waterproof pump enclosure according to the present invention.

Referring now to FIGS. 4-8 and 15A-15B, the pump enclosure 110 may also include a welded rear cover 123 positioned on an end of the body pipe 119 opposite the cover plate 122 and flange 140. The rear cover 123 may be welded onto the body pipe 119 to form a substantially watertight and/or waterproof seal, and it is understood that additional waterproofing may be applied to the joint between the rear cover 123 and the body pipe 119 in order to ensure that there is a watertight and/or waterproof seal so that the interior region of the pump enclosure 110 is at least substantially leak proof. As shown in FIG. 15A, the rear cover 123 may include one or more openings 124 that are configured and dimensioned to allow connections between the interior region of the pump enclosure 110 and items on the exterior of the pump enclosure.

Figure 10A:
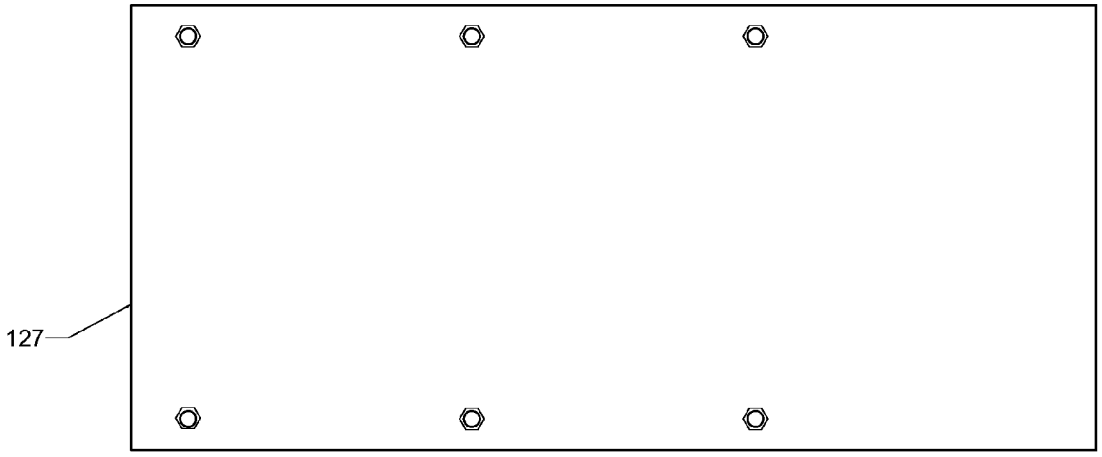
FIG. 10A is a top plan view of a mounting plate for the waterproof pump enclosure according to the present invention.
Figure 10B:
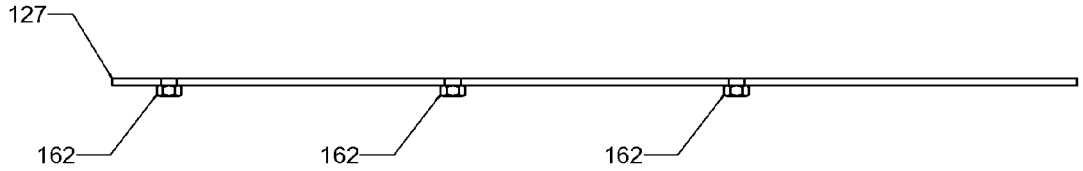
FIG. 10B is a side view of the mounting plate for the waterproof pump enclosure according to the present invention.
Figure 11A:
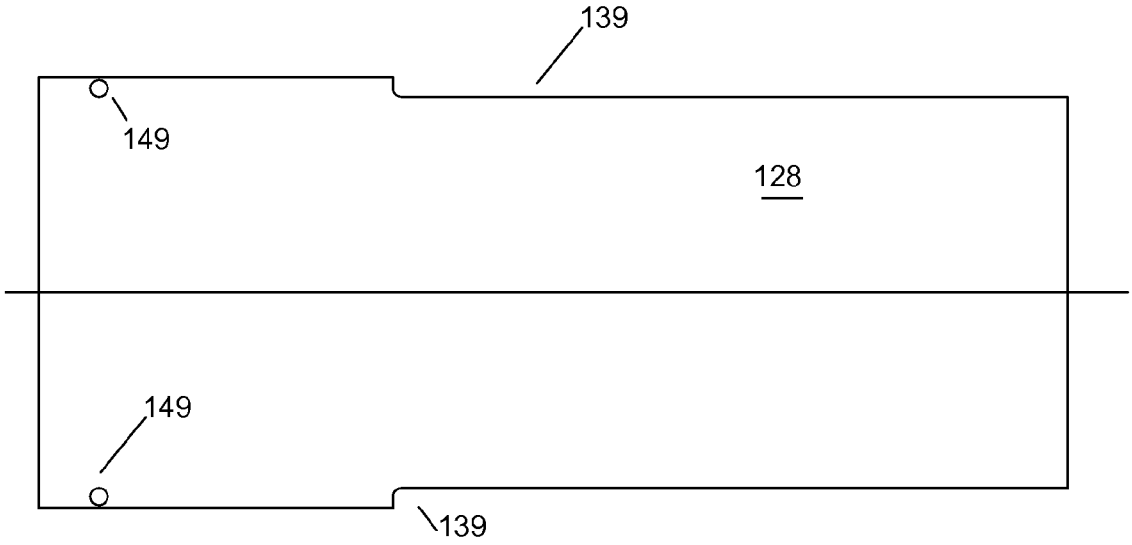
FIG. 11A is a top plan view of a sliding plate for the waterproof pump enclosure according to the present invention.
Figure 11B:
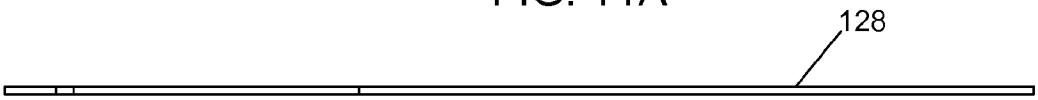
FIG. 11B is a side view of the sliding plate for the waterproof pump enclosure according to the present invention.

Referring now to FIGS. 4-8, 10A-10B and 11A-11B, the pump enclosure 110 is configured to contain a pump and motor assembly 150, which may be light oil pumps model numbers LO-203, LO-204, LO-205 or LO-206 available from Preferred Utilities Manufacturing Corp. of Danbury, Conn. The pump and motor assembly 150 may be mounted within the pump enclosure 110 on a mounting plate 127 that is secured to the body pipe 119. The mounting plate 127 may be secured to the body pipe 119 through welds and/or adhesives, or may be attached to the body pipe 119 by suitable brackets (not shown). The mounting plate 127 may be installed in the interior region of the pump enclosure 110 so that it forms a chord of the circle formed by the body pipe 119. It is preferable that the mounting plate 127 is installed in the body pipe 119 so that the mounting plate 127 is substantially level relative to a surface on which the pump enclosure 110 may be installed. As shown in FIGS. 10A and 10B, the mounting plate 127 may include one or more captive nuts 162, that may be used to secure fasteners to the mounting plate 127. While pump and motor assembly 150 may be attached directly to the mounting plate 127, the pump and motor assembly 150 may alternatively be attached to a sliding plate 128 that is movable relative to the mounting plate 127 so that the pump and motor assembly 150 may be at least partially removed from the pump enclosure 110 for service and/or maintenance. As shown in greater detail in FIGS. 11A and 11B, the sliding plate 128 may include side notches 139 in which the width of the sliding plate 128 is decreased over at least a portion of the sliding plate 128. In this manner, the sliding plate 128 can be retained between fasteners 156 installed into the captive nuts 162 of the mounting plate 127 in order to keep the sliding plate 128 in the appropriate alignment within the interior region of the pump enclosure 110. The sliding plate 128 may also include one or more bores 149, so that the fasteners 156 can be used to secure the sliding plate 128 to the mounting plate 127 when it is not desirable for the sliding plate 128 to move relative to the mounting plate 127. When it is desired to move the sliding plate 128 relative to the mounting plate 127, for example for service and/or maintenance of the pump and motor assembly 150, the fasteners 156 installed through the bores 149 can be removed so that the sliding plate 128 is movable relative to the mounting plate 127. Suitable lubricants and/or gliding mechanisms (not shown) can be installed between the sliding plate 128 and the mounting plate 127 to ensure smooth operation of the sliding plate 128 relative to the mounting plate 127.

Figure 6:
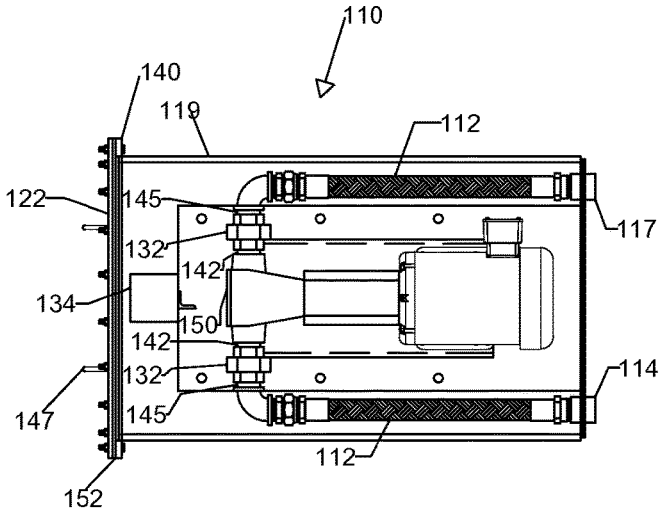
FIG. 6 is a top plan view of the other exemplary embodiment of the waterproof pump enclosure according to the present invention, shown transparently to show internal components.
Figure 4:
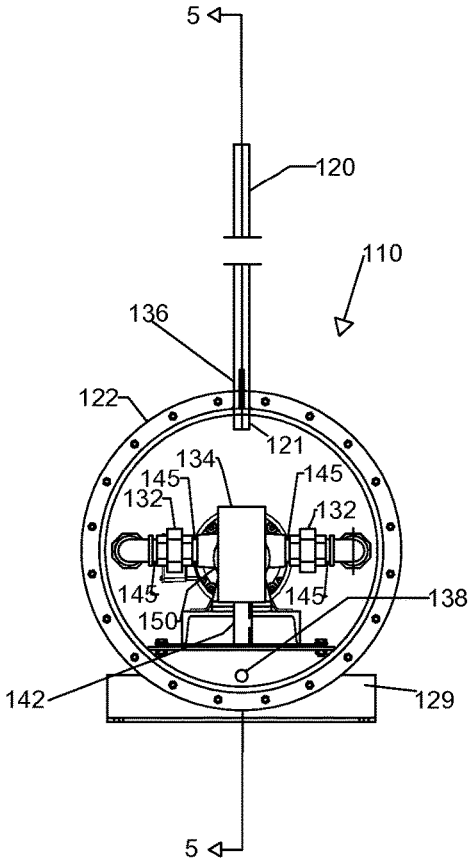
FIG. 4 is a front view of another exemplary embodiment of a waterproof pump enclosure according to the present invention, with the front cover plate shown transparently.
Figure 5:
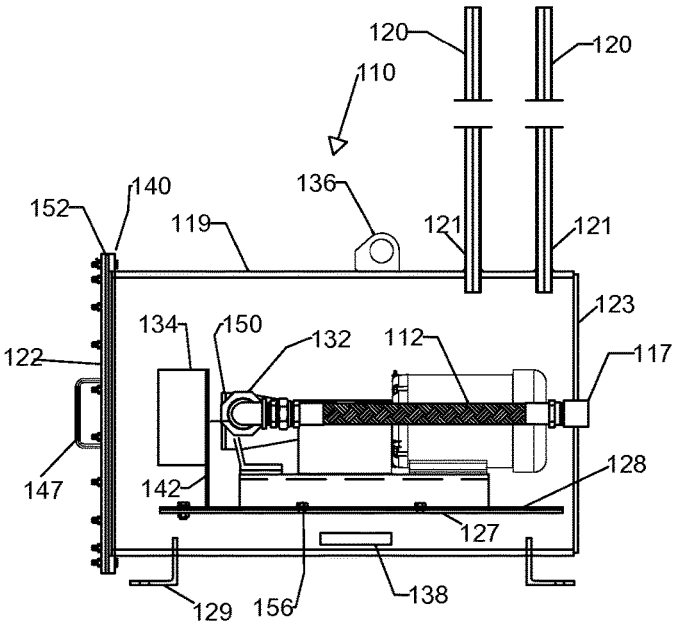
FIG. 5 is a cross-sectional view taken along line 5-5 in FIG. 4 of the waterproof pump enclosure according to the present invention.
Figure 7:
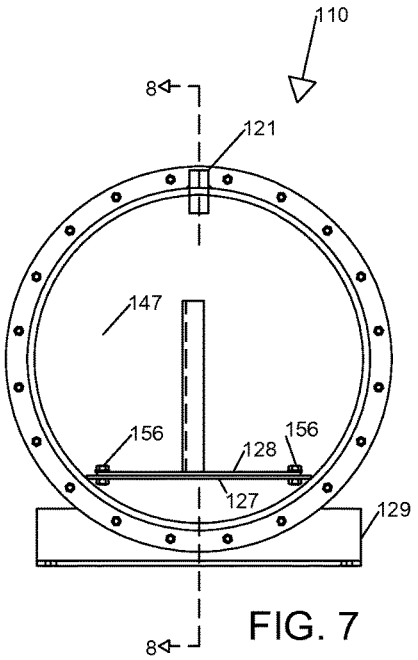
FIG. 7 is a front view of the other exemplary embodiment of the waterproof pump enclosure according to the present invention, shown transparently to show internal components.
Figure 8:
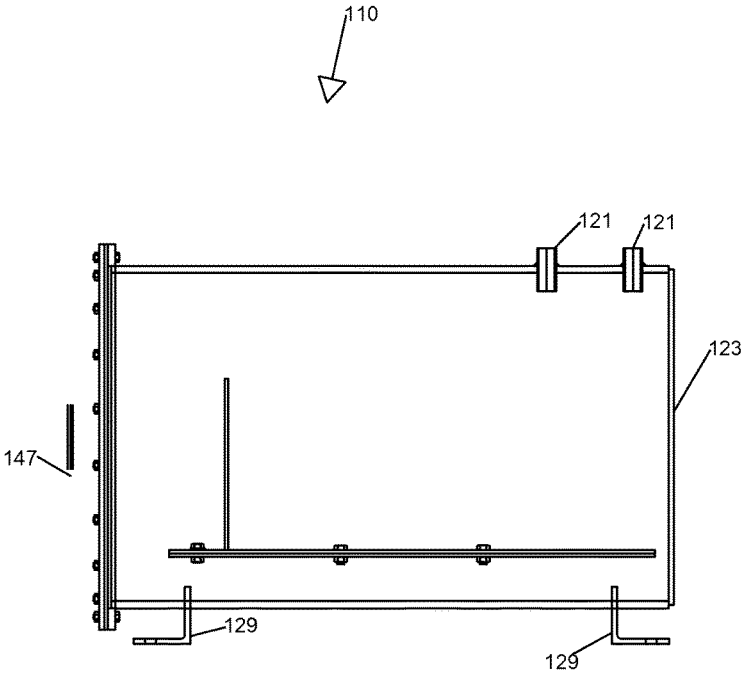
FIG. 8 is a cross-sectional view taken along line 8-8 in FIG. 7 of the waterproof pump enclosure according to the present invention.

Referring now to FIGS. 4-6, the pump enclosure 110 may also include a leak detector switch 138 that is configured to detect the presence of oil and/or water within the pump enclosure 110, and provide an indication as to their presence. The pump enclosure 110 may also include a disconnect switch 134 mounted to a disconnect bracket 142. The pump enclosure 110 may further include a supply inlet 114, and a discharge outlet 117 that provide passageways through the pump enclosure 110, but also provide for watertight connections between the flexible hose 112, which may be braided stainless steel over a Teflon core with carbon steel fittings, and an oil supply and an oil discharge lines (not shown). The supple inlet 114 and the discharge outlet 117 may be inserted through the openings 124 in the rear cover 123, or any other suitable openings made in the pump enclosure 110. The flexible hose 112 may be connected to the pump and motor assembly 150 by one or more nipples 145 and unions 132 in order to provide a substantially leak tight connection between the supply inlet 114, discharge outlet 117 and the pump and motor assembly 150. The pump enclosure 110 may also include one or more nipples 121 connected to the body pipe 119 and attached to the body pipe 119 so as to provide water tight connections between electrical conduit 120 running to the pump enclosure 110. The electrical conduit 120 may contain wiring for distributing power to the pump and motor assembly 150, as well as wiring for the leak sensor 138. The pump enclosure 110 may further include a lifting lug 136 attached to the body pipe 119 in order to facilitate installation of the pump enclosure 110.

Referring now to FIGS. 4-8 and 14A-14C, the pump enclosure 110 may also include one or more mounting brackets 129 attached to an underside of the body pipe 119. It is understood that underside is merely used for reference, and the positioning of the mounting brackets 129 are not limited to any particular location on the pump enclosure 110. However, it is preferable that the mounting brackets 129 are positioned substantially parallel with the mounting plate 127 so that the mounting plate 127 may be substantially level with the surface on which the pump enclosure 110 may be installed. As shown in greater detail in FIGS. 14A-14C, the mounting brackets 129 include a cutout portion 165 to provide cradle for the body pipe 119 to rest in on the mounting bracket 129. It is understood that the cutout portion 165 should have substantially the same radius as the body pipe 119 so that as much of the body pipe 119 will be in contact with the mounting bracket 129 as possible. It is further understood that the body pipe 119 may be affixed to the mounting brackets 129 through any suitable welding and/or adhesive mechanism. The mounting brackets 129 may also include one or more bores 167 through which fasteners (not shown), such as bolts, screws, nails, pins, stakes, any combination thereof or the like may be inserted in order to attach the pump enclosure 110 to the surface on which it will be mounted.

Figure 30:
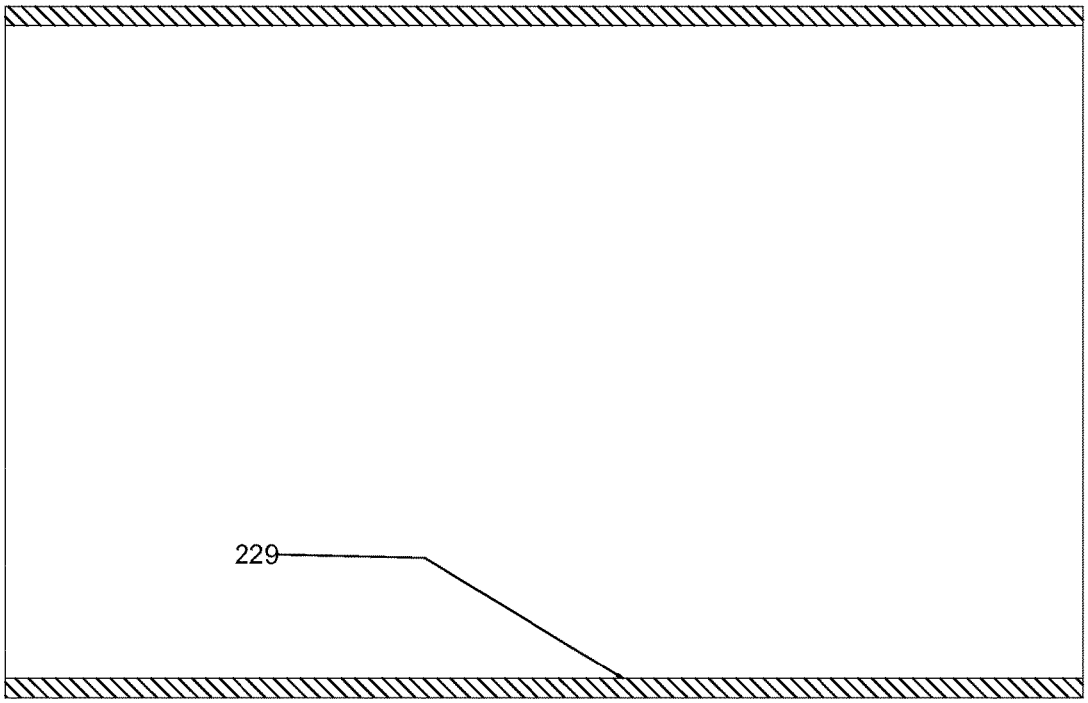
FIG. 30 is a cross-sectional view of an exemplary body pipe for the waterproof pump enclosure according to the present invention.
Figures 31A, 31B:
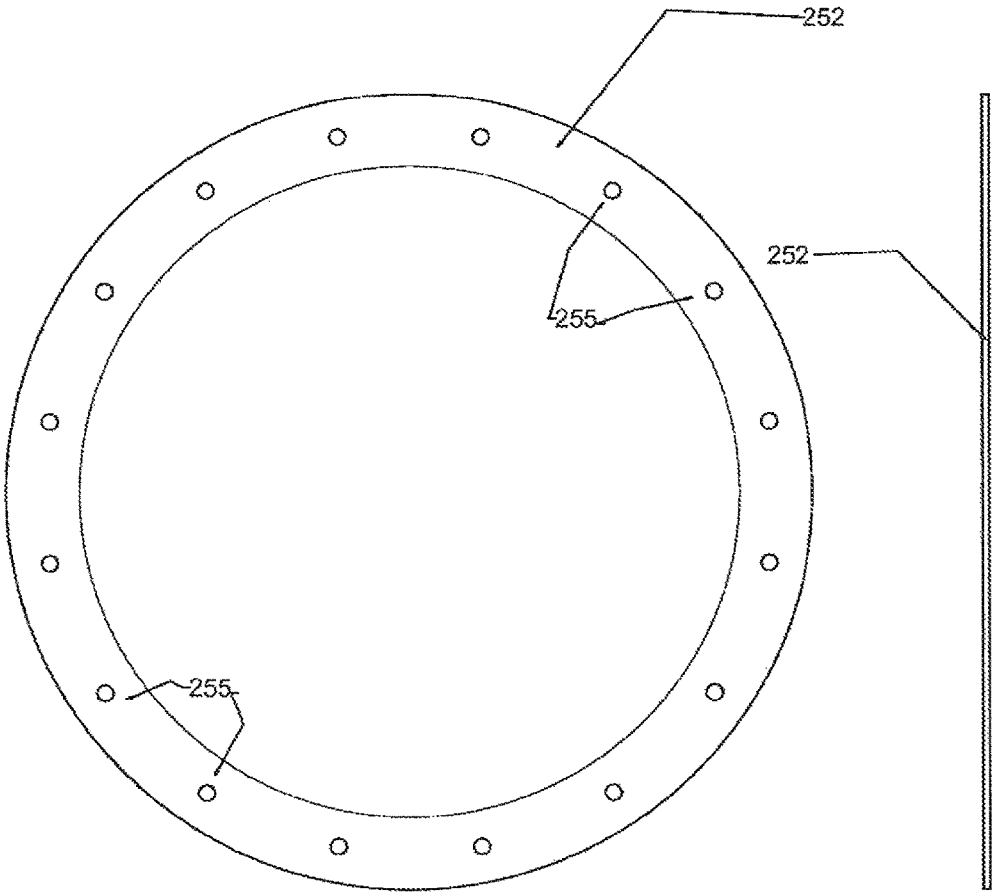
FIG. 31A is a front view of an exemplary flange gasket for the waterproof pump enclosure according to the present invention.
FIG. 31B is a side view of the exemplary flange gasket for the waterproof pump enclosure according to the present invention.
Figure 32:
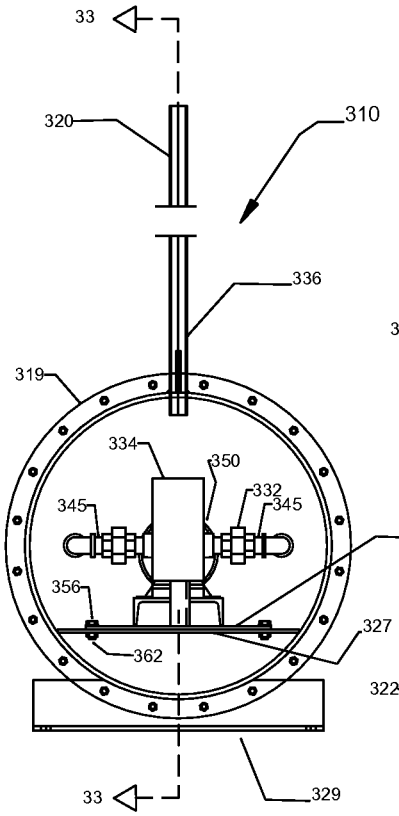
FIG. 32 is a front view of another exemplary embodiment of a waterproof pump enclosure according to the present invention, with the front cover plate shown transparently.
Figure 34:
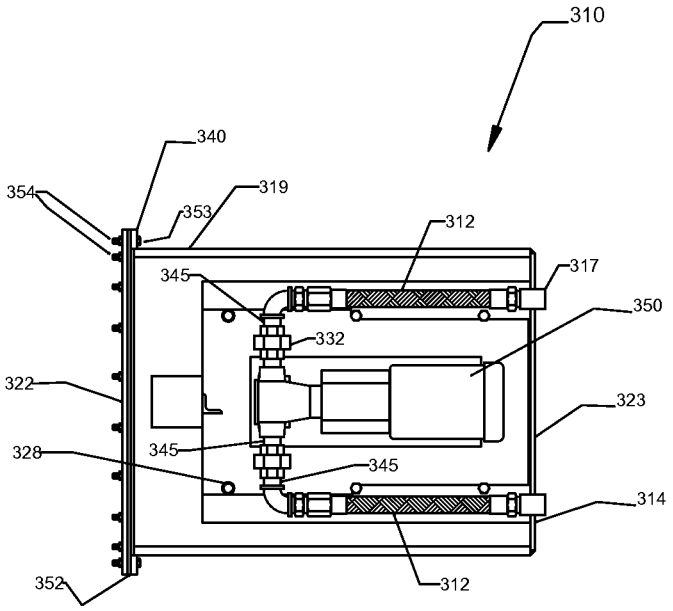
FIG. 34 is a top plan view of the other exemplary embodiment of the waterproof pump enclosure according to the present invention, shown transparently to show internal components.
Figure 33:
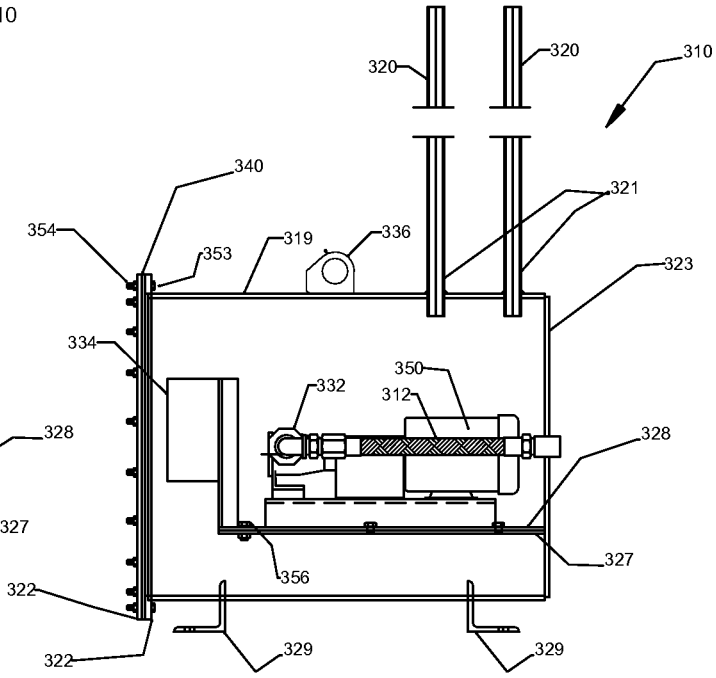
FIG. 33 is a cross-sectional view taken along line 33-3 in FIG. 32 of the waterproof pump enclosure according to the present invention.
Figure 35:
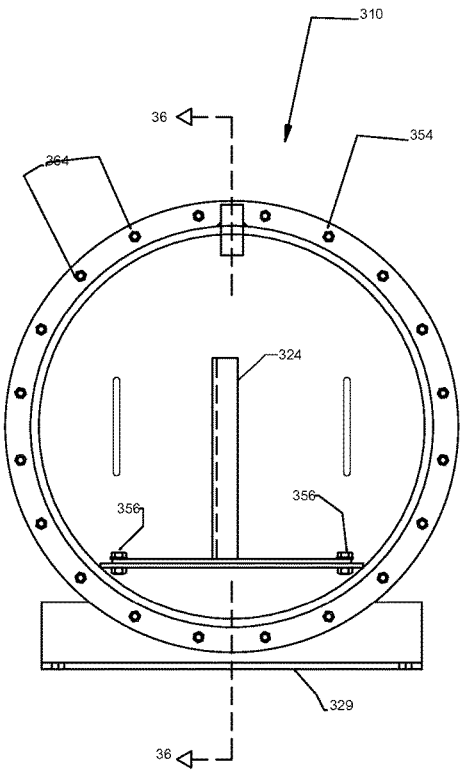
FIG. 35 is a front view of the other exemplary embodiment of the waterproof pump enclosure according to the present invention, shown transparently to show internal components.
Figure 36:
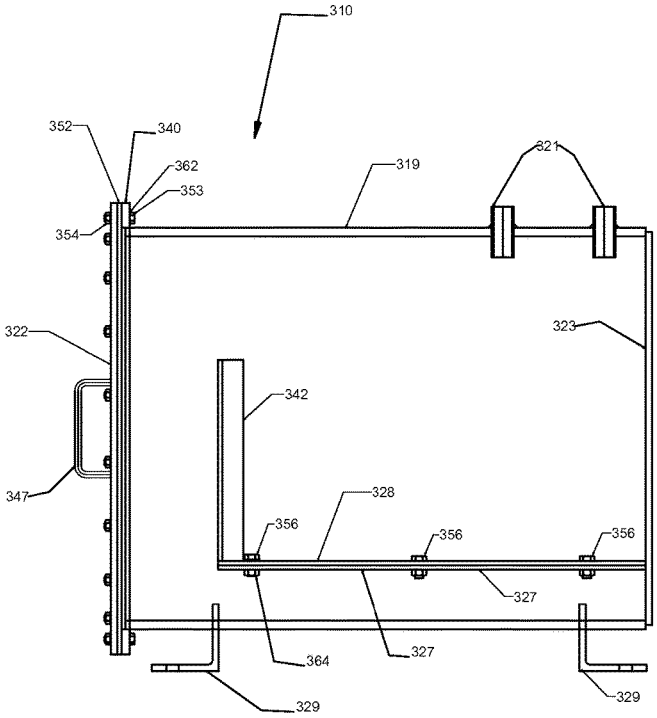
FIG. 36 is a cross-sectional view taken along line 36-36 in FIG. 35 of the waterproof pump enclosure according to the present invention.

Referring now to FIGS. 18-22, another exemplary embodiment of a pump enclosure, generally indicated by reference numeral 210, according to the present invention is shown. The pump enclosure 210 may include a substantially circular body pipe 219 that may be formed from epoxy-enamel painted carbon steel to form a hollow enclosure. The exemplary body pipe 219 that may be used with the pump enclosure 210 is shown by itself in FIG. 30. It is understood that while the body pipe 219 is shown with a substantially cylindrical configuration, the body pipe 219 may have any suitable shape and/or configuration in accordance with the present invention.

Figure 26A:
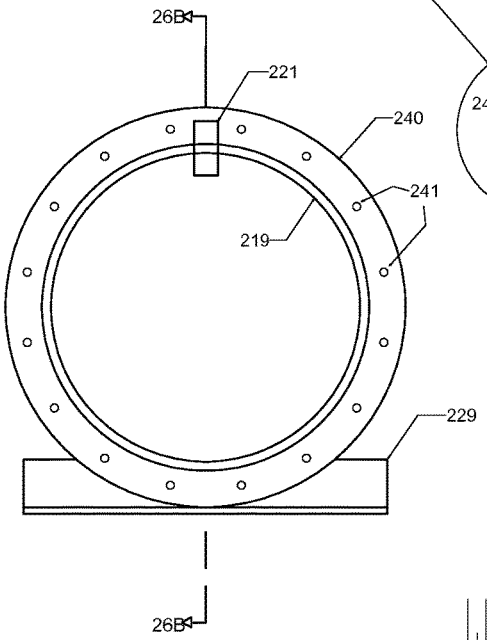
FIG. 26A is a front view of the waterproof pump enclosure with the cover assembly removed and without internal components.
Figure 26B:
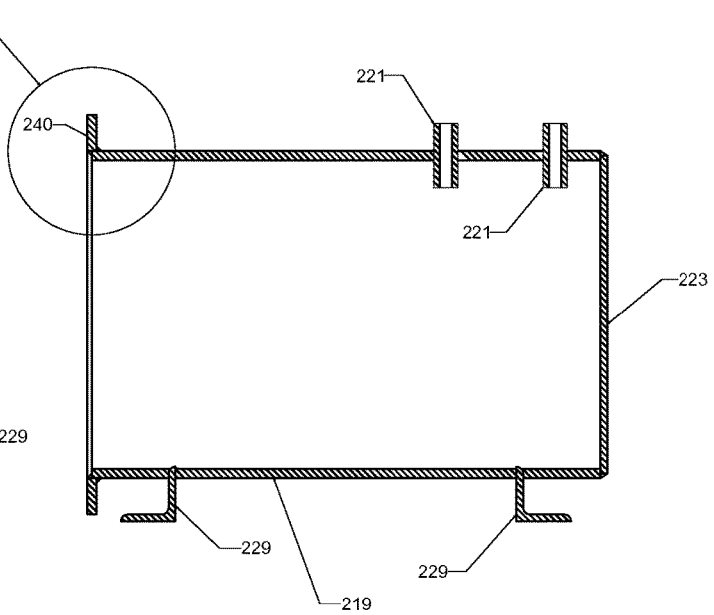
FIG. 26B is a cross-sectional view taken along line 26B-26B in FIG. 26A.
Figure 26C:
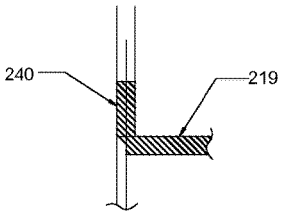
FIG. 26C is an enlarged view of Section 26C from FIG. 26B.
Figure 27A:
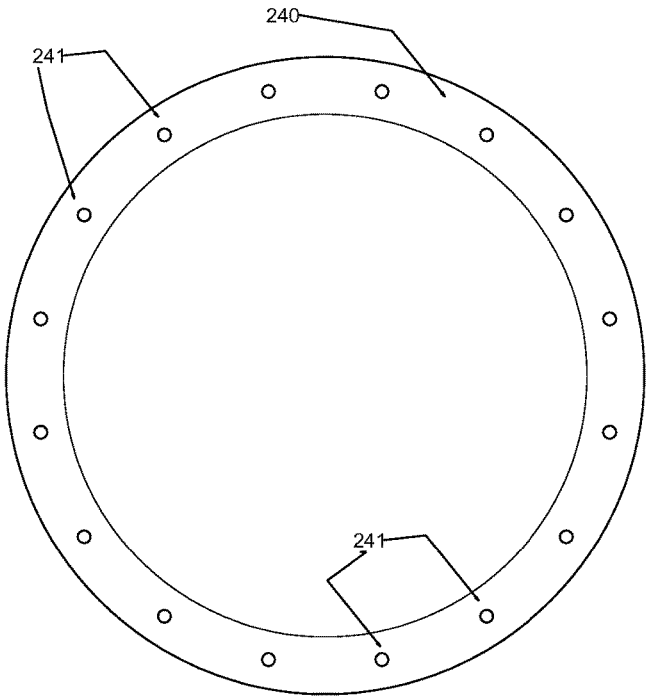
FIG. 27A is a front view of an exemplary flange for the waterproof pump enclosure according to the present invention.
Figure 27B:
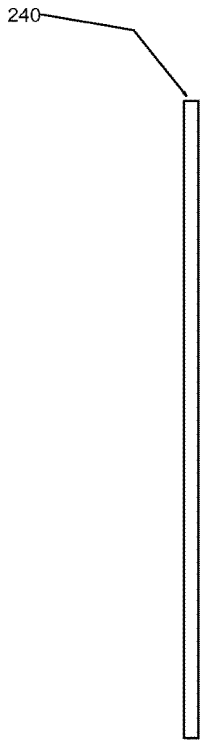
FIG. 27B is a side view of the exemplary flange for the waterproof pump enclosure according to the present invention.
Figure 28C:
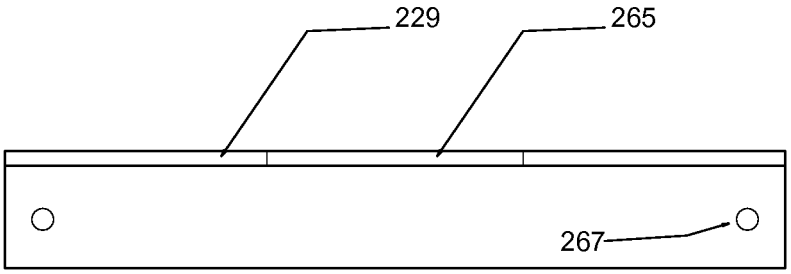
FIG. 28C is a top plan view of the exemplary mounting bracket for the waterproof pump enclosure according to the present invention.
Figure 28B:
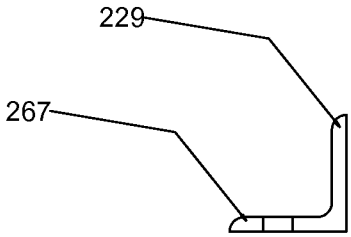
FIG. 28B is a cross-sectional view taken along line 28B-28B in FIG. 28A of the exemplary mounting bracket for the waterproof pump enclosure according to the present invention.
Figure 28A:
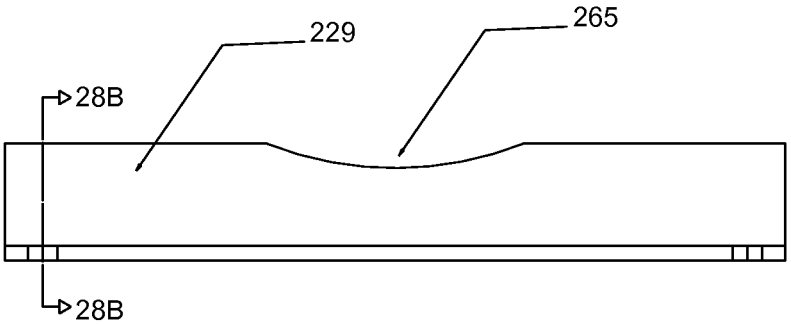
FIG. 28A is a front view of an exemplary mounting bracket for the waterproof pump enclosure according to the present invention.

Referring now to FIGS. 18-22, 26A-26C and 27A-27B, the pump enclosure 210 may also include a flange 240 formed on one end of the body pipe 219. As shown by FIGS. 26B and 26C, the flange 240 may be positioned substantially perpendicular to the body pipe 219 so that the flange 240 provides a mounting surface for the body pipe 219. The flange 240 may be integrally formed with the body pipe 219, or constructed of a separate component, for example as shown in FIGS. 27A and 27B, and affixed to the body pipe 219 through suitable welding and/or adhesive. As shown in FIG. 27A, the flange 240 includes a plurality of bores 241 formed there through and positioned around the circumference of the flange 240. The bores 241 may be positioned in any pattern or formation around the flange 240, and it may be preferable that the bores 241 are positioned so that any fastening device, as discussed below, used on the flange 240 provides a substantially equal clamping pressure around the circumference of the flange 240.

Referring now to FIGS. 18-22, 23A-23B and 31A-31B, the pump enclosure 210 may also include a cover plate 222 that is configured to be secured to the flange 240 by one or more suitable fasteners, such as a bolt 253 and nut 254 combination. It is understood that any suitable fastener may be used to secure the cover plate 222 to the flange 240, but it is preferable that the fasteners are capable of releasing the cover plate 222 from the flange 240 through appropriate removable mechanisms and/or tools so that access to the interior of the pump enclosure 210 can be gained without substantial effort or difficulty. While a bolt 253 and nut 254 combination is provided as an example of a suitable fastener, it is understood that such combination is merely exemplary and that the fasteners may also include screws that engage with threads within the bores 241 of the flange 240. A gasket 252, as shown in greater detail in FIGS. 31A-31B, for example a gasket made from neoprene rubber, may be placed between the cover plate 222 and flange 240 so as to provide a water tight connection between the cover plate 222 and the flange 240 so as to seal the pump enclosure 210. The gasket 252 may include one or more bores 255 positioned around the circumference of the gasket 252 so that the fasteners 253, 254 may be inserted through the cover plate 222, gasket 252 and flange 240. Preferably, the bores 255 formed through the gasket 252 are positioned for alignment with the bores 241 formed in the flange 240, and preferably the same number of bores 241 formed in the flange 240 are present in the gasket 252. However, it is understood that additional bores 255 may be formed in the gasket 252 than those formed in the flange 240 so that alignment and installation of the gasket 252 on the flange 240 may be facilitated. Referring now more particularly to FIGS. 23A and 23B, cover plate 222 may include one or more handles 247 to facilitate removal and installation of the cover plate 222, and may also include one or more bores 225 positioned around the circumference of the cover plate 222 so that the fasteners 253, 254 may be inserted through the cover plate 222, gasket 253 and flange 240. The handles 247 may be formed from substantially U-shaped or C-shaped rod or bar, and securely affixed to the cover plate 222. The one or more bores 225 are positioned around the cover plate 222 so that when the cover plate 222 is applied to the flange 240 the bores 241 on the flange 240 substantially align with the bores 225 on the cover plate 222 so that the fasteners 253, 254 can secure the cover plate 222 to the flange 240. It is understood that the bores 225 on the cover plate 222 may be the same number as the bores 241 on the flange 240 or may be greater or lesser in number depending upon the desired application.

Figure 29B:
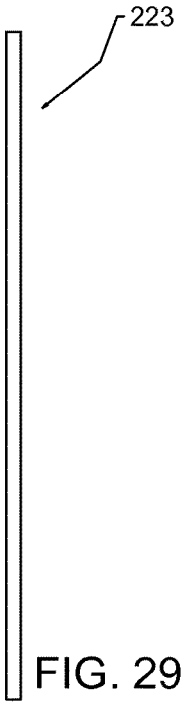
FIG. 29B is a side view of the exemplary back cover plate for the waterproof pump enclosure according to the present invention.
Figure 29A:
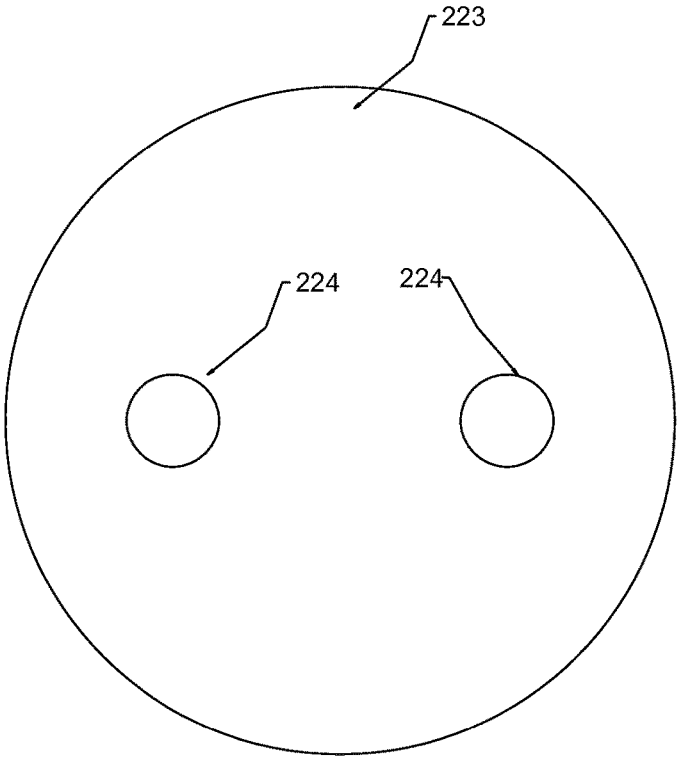
FIG. 29A is a front view of an exemplary back cover plate for the waterproof pump enclosure according to the present invention.

Referring now to FIGS. 18-22 and 29A-29B, the pump enclosure 210 may also include a welded rear cover 223 positioned on an end of the body pipe 219 opposite the cover plate 222 and flange 240. The rear cover 223 may be welded onto the body pipe 219 to form a substantially watertight and/or waterproof seal, and it is understood that additional waterproofing may be applied to the joint between the rear cover 223 and the body pipe 219 in order to ensure that there is a watertight and/or waterproof seal so that the interior region of the pump enclosure 210 is at least substantially leak proof. As shown in FIG. 29A, the rear cover 223 may include one or more openings 224 that are configured and dimensioned to allow connections between the interior region of the pump enclosure 210 and items on the exterior of the pump enclosure.

Referring now to FIGS. 18-22, 24A-24B and 25A-25B, the pump enclosure 210 is configured to contain a pump and motor assembly 250, such as model numbers LO-101E, LO-102E, LO-103E, LO-104E, LO-105E or LO-106E available from Preferred Utilities Manufacturing Corp. of Danbury, Conn. The pump and motor assembly 250 may be mounted within the pump enclosure 210 on a mounting plate 227 that is secured to the body pipe 119. The mounting plate 227 may be secured to the body pipe 219 through welds and/or adhesives, or may be attached to the body pipe 219 by suitable brackets (not shown). The mounting plate 227 may be installed in the interior region of the pump enclosure 210 so that it forms a chord of the circle formed by the body pipe 219. It is preferable that the mounting plate 227 is installed in the body pipe 219 so that the mounting plate 227 is substantially level relative to a surface on which the pump enclosure 210 may be installed. As shown in greater detail in FIGS. 24A and 24B, the mounting plate 227 may include one or more captive nuts 262, that may be used to secure fasteners to the mounting plate 227. While pump and motor assembly 250 may be attached directly to the mounting plate 227, the pump and motor assembly 250 may alternatively be attached to a sliding plate 228 that is movable relative to the mounting plate 227 so that the pump and motor assembly 250 may be at least partially removed from the pump enclosure 210 for service and/or maintenance. As shown in greater detail in FIGS. 25A and 25B, the sliding plate 228 may include side notches 239 in which the width of the sliding plate 228 is decreased over at least a portion of the sliding plate 228. In this manner, the sliding plate 228 can be retained between fasteners 256 installed into the captive nuts 262 of the mounting plate 227 in order to keep the sliding plate 228 in the appropriate alignment within the interior region of the pump enclosure 210. The sliding plate 228 may also include one or more bores 249, so that the fasteners 256 can be used to secure the sliding plate 228 to the mounting plate 227 when it is not desirable for the sliding plate 228 to move relative to the mounting plate 227. When it is desired to move the sliding plate 228 relative to the mounting plate 227, for example for service and/or maintenance of the pump and motor assembly 250, the fasteners 256 installed through the bores 249 can be removed so that the sliding plate 228 is movable relative to the mounting plate 227. Suitable lubricants and/or gliding mechanisms (not shown) can be installed between the sliding plate 228 and the mounting plate 227 to ensure smooth operation of the sliding plate 228 relative to the mounting plate 227.

Figure 20:
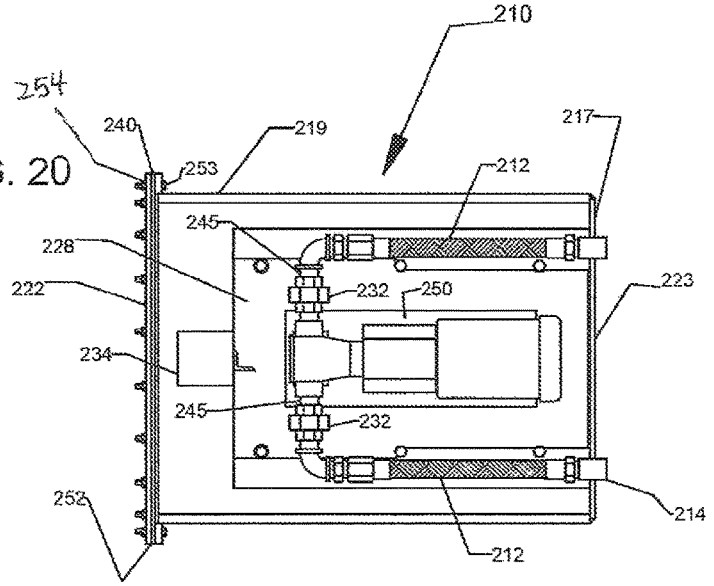
FIG. 20 is a top plan view of the other exemplary embodiment of the waterproof pump enclosure according to the present invention, shown transparently to show internal components.
Figure 18:
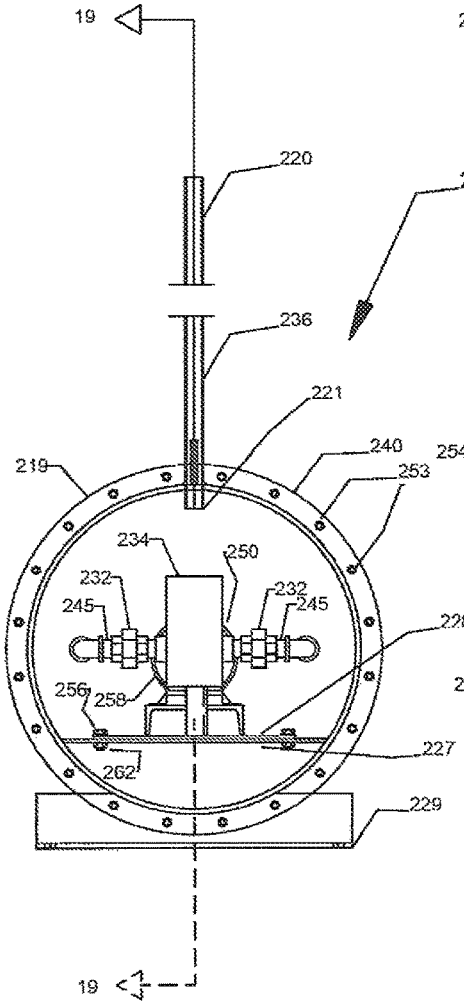
FIG. 18 is a front view of another exemplary embodiment of a waterproof pump enclosure according to the present invention, with the front cover plate shown transparently.
Figure 19:
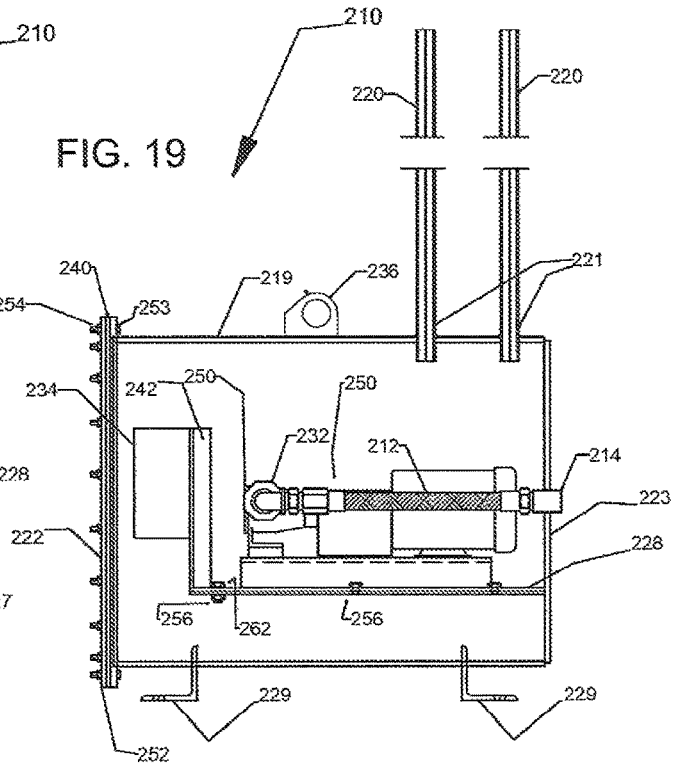
FIG. 19 is a cross-sectional view taken along line 19-19 in FIG. 18 of the waterproof pump enclosure according to the present invention.
Figure 21:
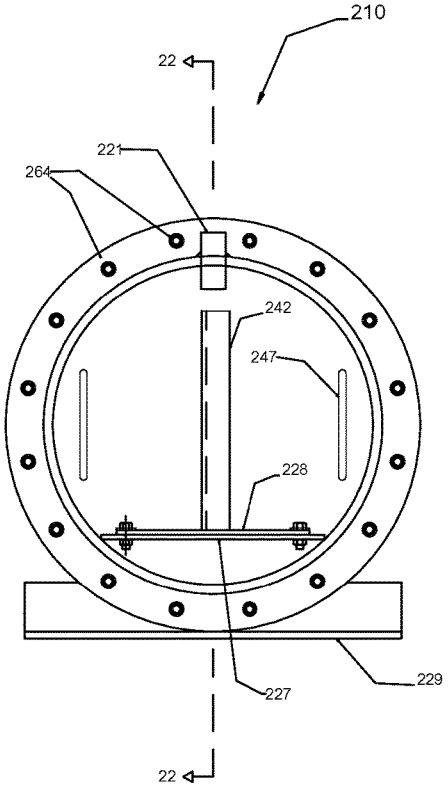
FIG. 21 is a front view of the other exemplary embodiment of the waterproof pump enclosure according to the present invention, shown transparently to show internal components.
Figure 22:
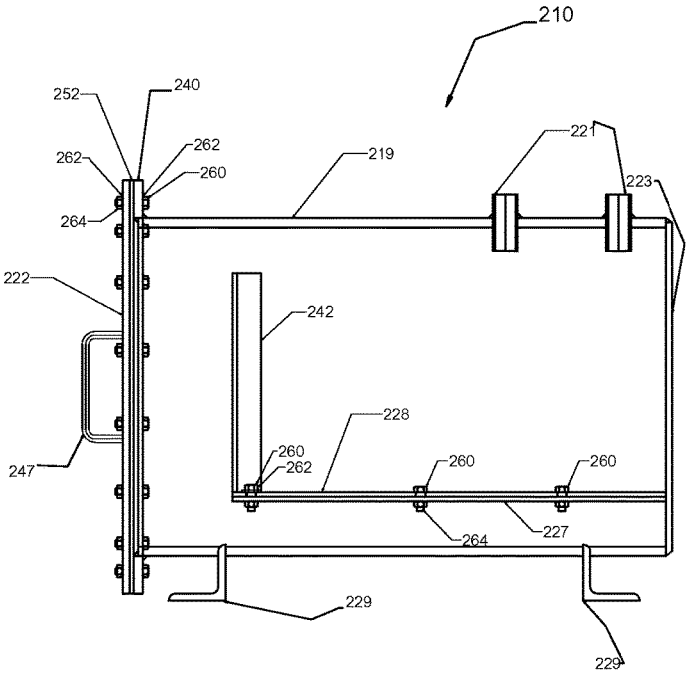
FIG. 22 is a cross-sectional view taken along line 22-22 in FIG. 21 of the waterproof pump enclosure according to the present invention.
Figures 24A, 24B:
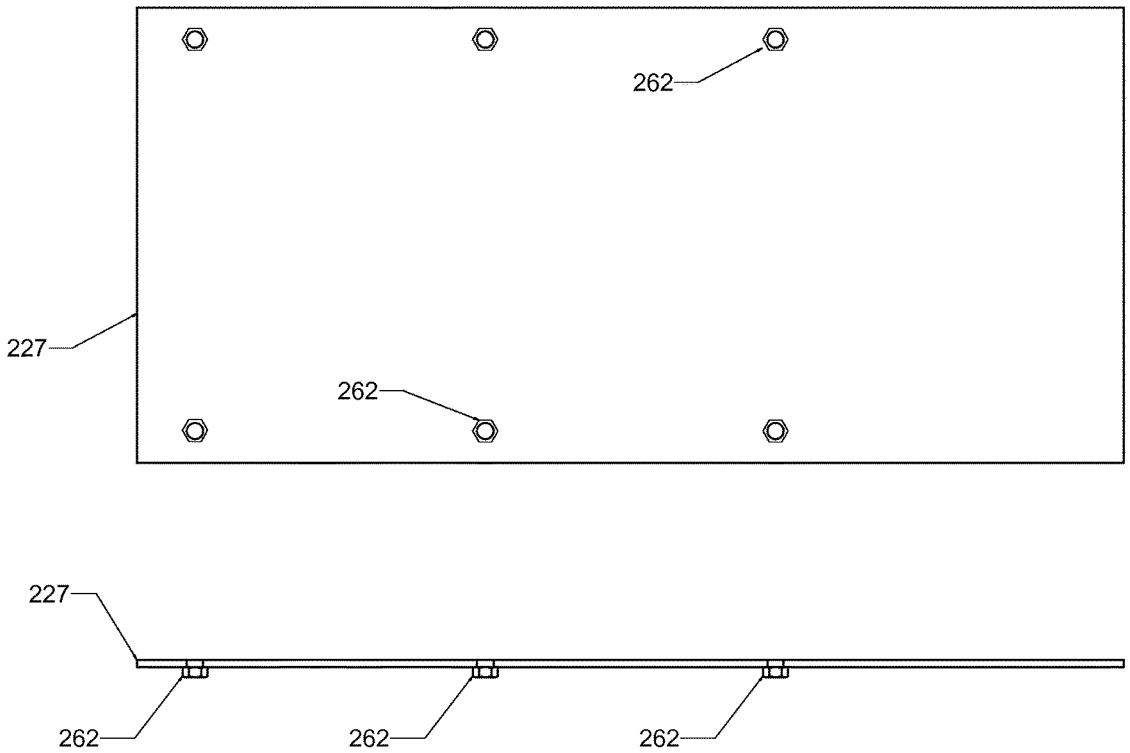
FIG. 24A is a top plan view of a mounting plate for the waterproof pump enclosure according to the present invention.
FIG. 24B is a side view of the mounting plate for the waterproof pump enclosure according to the present invention.
Figures 25A, 25B:
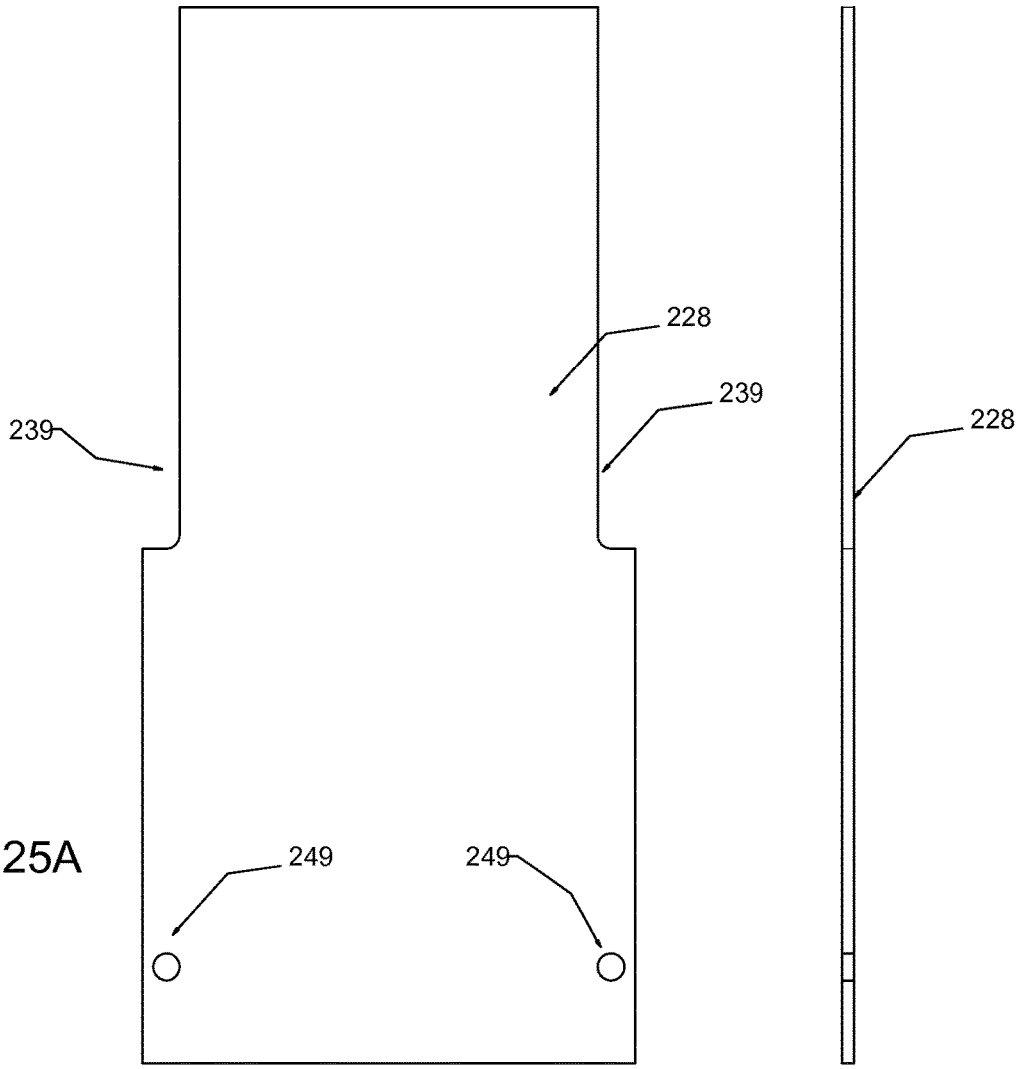
FIG. 25A is a top plan view of a sliding plate for the waterproof pump enclosure according to the present invention.
FIG. 25B is a side view of the sliding plate for the waterproof pump enclosure according to the present invention.

Referring now to FIGS. 18-20, the pump enclosure 210 may also include a leak detector switch (not shown) that is configured to detect the presence of oil and/or water within the pump enclosure 210, and provide an indication as to their presence. The pump enclosure 210 may also include a disconnect switch 234 mounted to a disconnect bracket 242. The pump enclosure 210 may further include a supply inlet 214, and a discharge outlet 217 that provide passageways through the pump enclosure 210, but also provide for watertight connections between the flexible hose 212, which may be braided stainless steel over a Teflon core with carbon steel fittings, and an oil supply and an oil discharge lines (not shown). The supple inlet 214 and the discharge outlet 217 may be inserted through the openings 224 in the rear cover 223, or any other suitable openings made in the pump enclosure 210. The flexible hose 212 may be connected to the pump and motor assembly 250 by one or more nipples 245 and unions 232 in order to provide a substantially leak tight connection between the supply inlet 214, discharge outlet 217 and the pump and motor assembly 250. The pump enclosure 210 may also include one or more nipples 221 connected to the body pipe 219 and attached to the body pipe 219 so as to provide water tight connections between electrical conduit 220 running to the pump enclosure 210. The electrical conduit 220 may contain wiring for distributing power to the pump and motor assembly 250, as well as wiring for the leak sensor (not shown). The pump enclosure 210 may further include a lifting lug 236 attached to the body pipe 219 in order to facilitate installation of the pump enclosure 210.

Referring now to FIGS. 18-22 and 28A-28C, the pump enclosure 210 may also include one or more mounting brackets 229 attached to an underside of the body pipe 219. It is understood that underside is merely used for reference, and the positioning of the mounting brackets 229 are not limited to any particular location on the pump enclosure 210. However, it is preferable that the mounting brackets 229 are positioned substantially parallel with the mounting plate 227 so that the mounting plate 227 may be substantially level with the surface on which the pump enclosure 210 may be installed. As shown in greater detail in FIGS. 28A-28C, the mounting brackets 229 include a cutout portion 265 to provide cradle for the body pipe 219 to rest in on the mounting bracket 229. It is understood that the cutout portion 265 should have substantially the same radius as the body pipe 219 so that as much of the body pipe 219 will be in contact with the mounting bracket 229 as possible. It is further understood that the body pipe 219 may be affixed to the mounting brackets 229 through any suitable welding and/or adhesive mechanism. The mounting brackets 229 may also include one or more bores 267 through which fasteners (not shown), such as bolts, screws, nails, pins, stakes, any combination thereof or the like may be inserted in order to attach the pump enclosure 210 to the surface on which it will be mounted.

Figure 44:
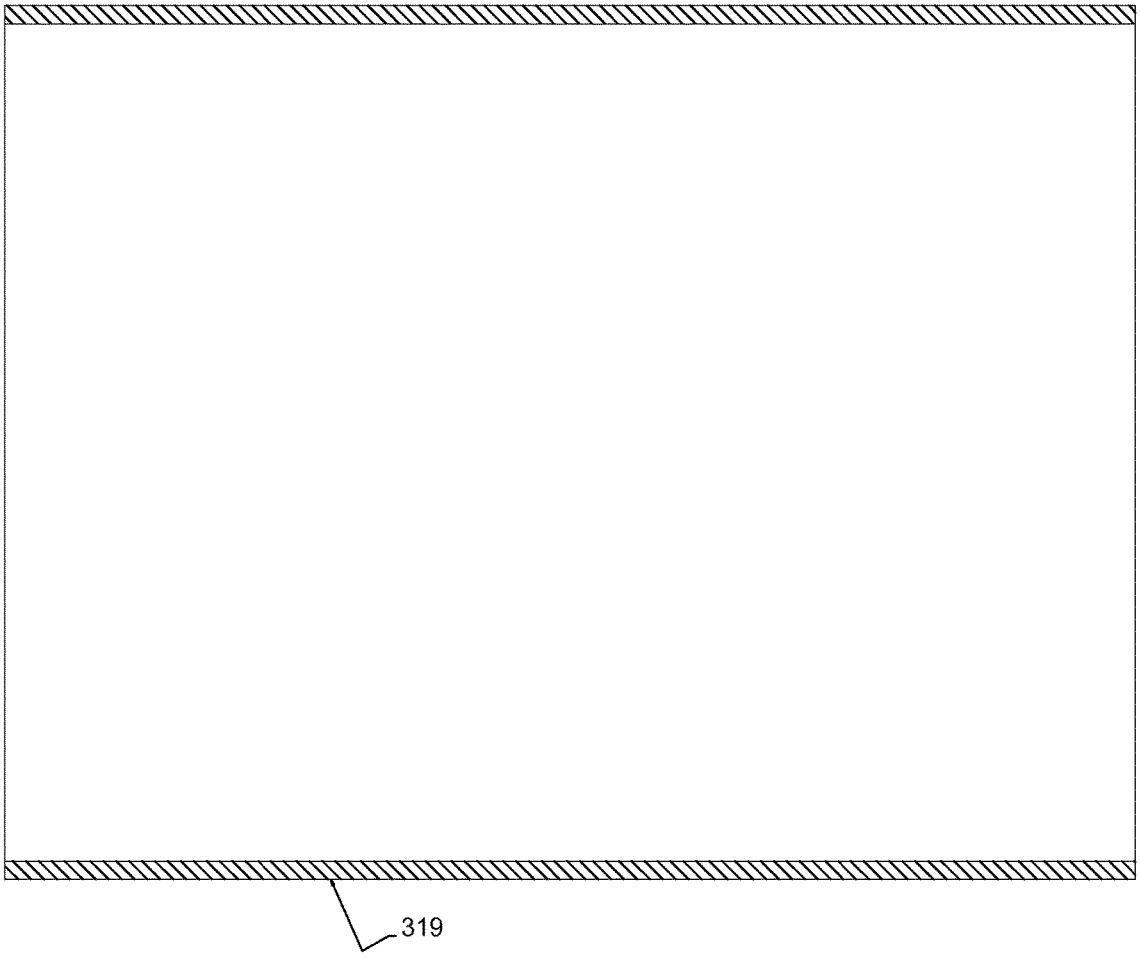
FIG. 44 is a cross-sectional view of an exemplary body pipe for the waterproof pump enclosure according to the present invention.
Figure 45B:
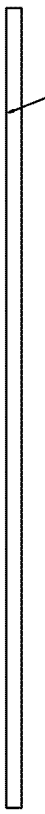
FIG. 45B is a side view of the exemplary flange gasket for the waterproof pump enclosure according to the present invention.
Figure 45A:
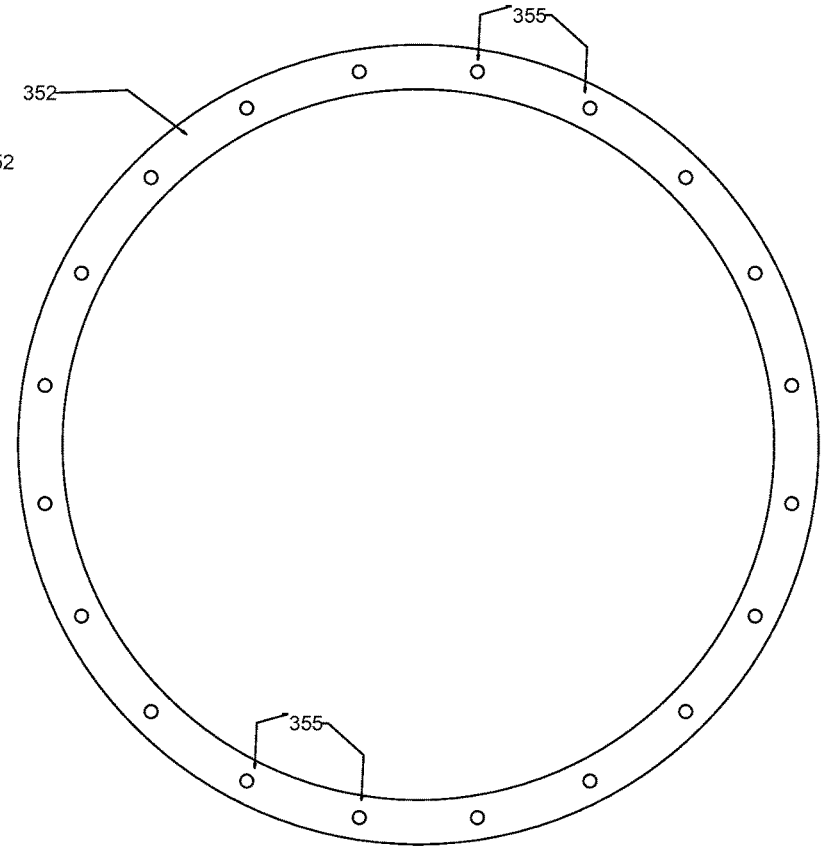
FIG. 45A is a front view of an exemplary flange gasket for the waterproof pump enclosure according to the present invention.

Referring now to FIGS. 32-36, another exemplary embodiment of a pump enclosure, generally indicated by reference numeral 310, according to the present invention is shown. The pump enclosure 310 may include a substantially circular body pipe 319 that may be formed from epoxy-enamel painted carbon steel to form a hollow enclosure. The exemplary body pipe 319 that may be used with the pump enclosure 310 is shown by itself in FIG. 44. It is understood that while the body pipe 319 is shown with a substantially cylindrical configuration, the body pipe 319 may have any suitable shape and/or configuration in accordance with the present invention.

Figure 40A:
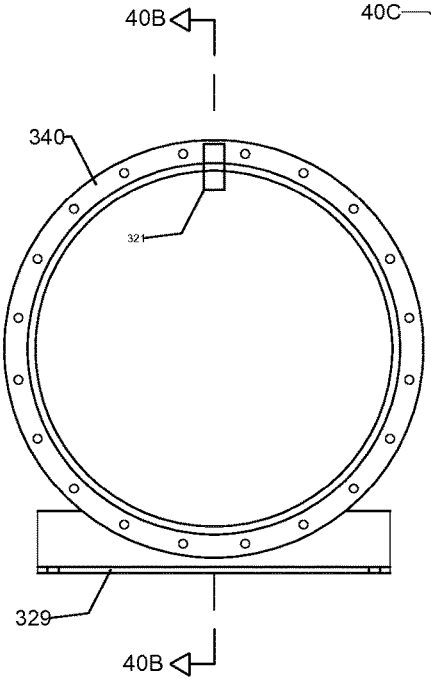
FIG. 40A is a front view of the waterproof pump enclosure with the cover assembly removed and without internal components.
Figure 40B:
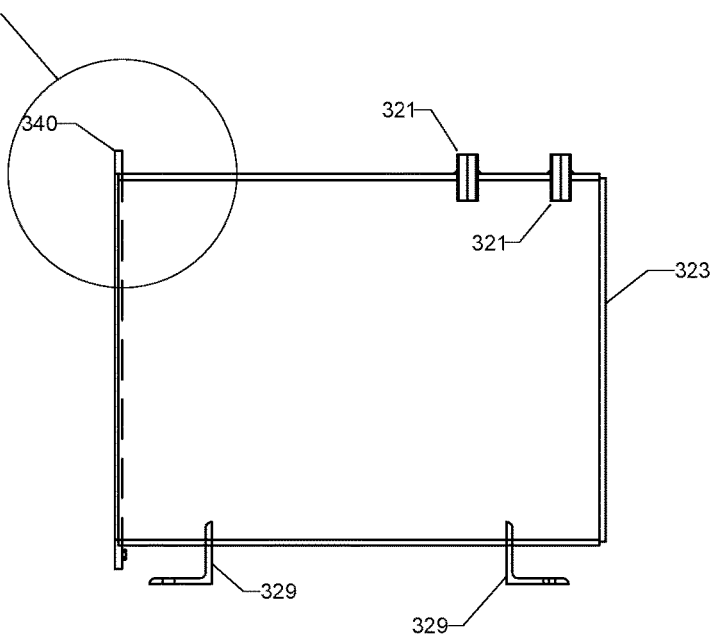
FIG. 40B is a cross-sectional view taken along line 40B-40B in FIG. 40A.
Figure 40C:
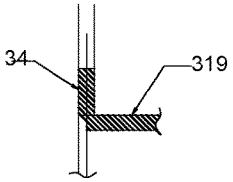
FIG. 40C is an enlarged view of Section 40C from FIG. 40B.
Figure 41B:
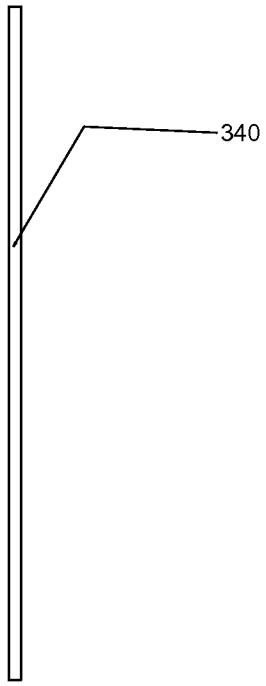
FIG. 41B is a side view of the exemplary flange for the waterproof pump enclosure according to the present invention.
Figure 41A:
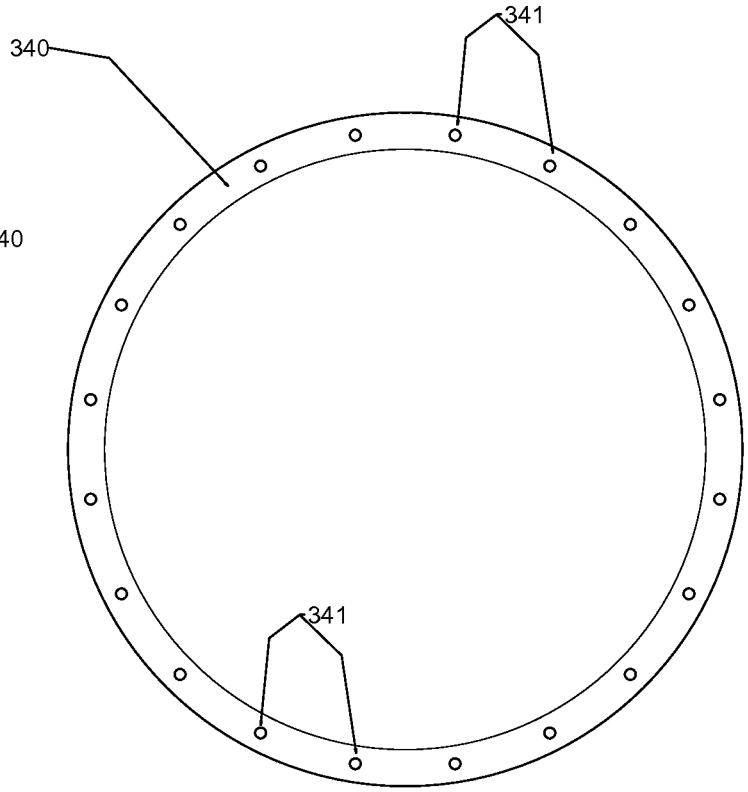
FIG. 41A is a front view of an exemplary flange for the waterproof pump enclosure according to the present invention.
Figure 42C:
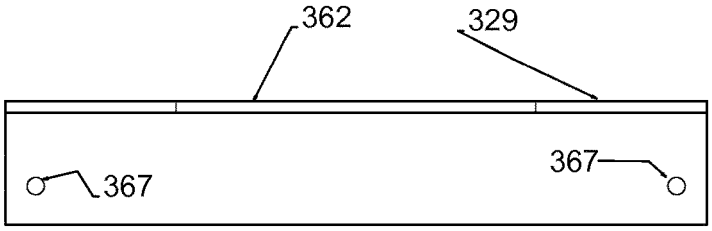
FIG. 42C is a top plan view of the exemplary mounting bracket for the waterproof pump enclosure according to the present invention.
Figure 42A:
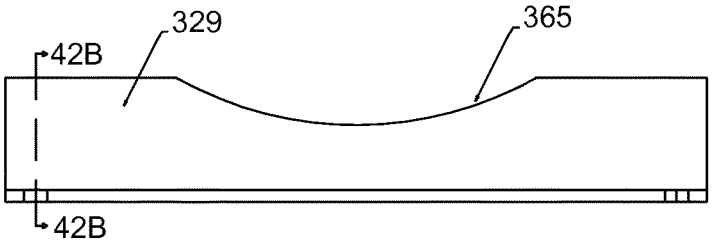
FIG. 42A is a front view of an exemplary mounting bracket for the waterproof pump enclosure according to the present invention.
Figure 42B:
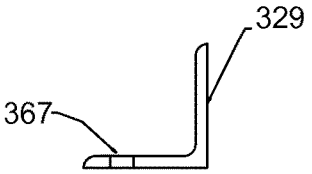
FIG. 42B is a cross-sectional view taken along line 42B-42B in FIG. 42A of the exemplary mounting bracket for the waterproof pump enclosure according to the present invention.

Referring now to FIGS. 32-36, 40A-40C and 41A-41B, the pump enclosure 310 may also include a flange 340 formed on one end of the body pipe 319. As shown by FIGS. 40B and 40C, the flange 340 may be positioned substantially perpendicular to the body pipe 319 so that the flange 340 provides a mounting surface for the body pipe 319. The flange 340 may be integrally formed with the body pipe 319, or constructed of a separate component, for example as shown in FIGS. 41A and 41B, and affixed to the body pipe 319 through suitable welding and/or adhesive. As shown in FIG. 41A, the flange 340 includes a plurality of bores 341 formed there through and positioned around the circumference of the flange 340. The bores 341 may be positioned in any pattern or formation around the flange 340, and it may be preferable that the bores 341 are positioned so that any fastening device, as discussed below, used on the flange 340 provides a substantially equal clamping pressure around the circumference of the flange 340.

Figure 37A:
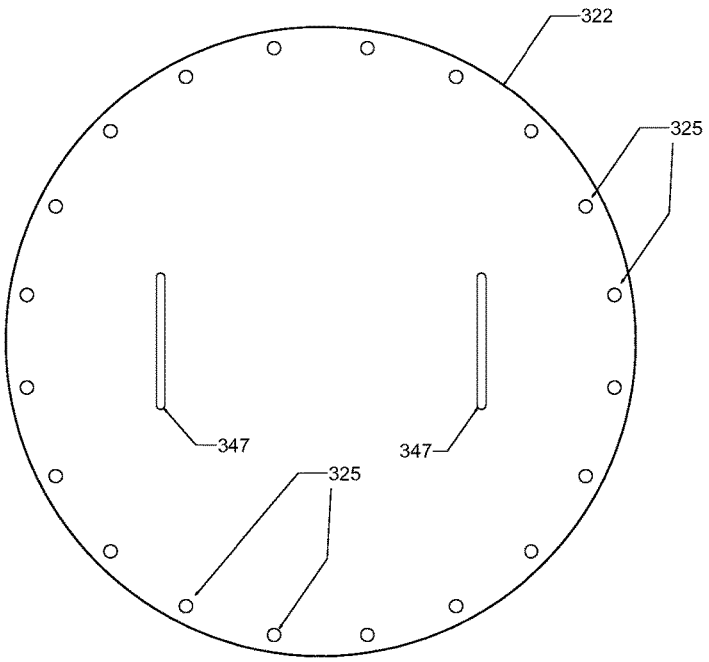
FIG. 37A is a front view of a cover assembly for the waterproof pump enclosure according to the present invention.
Figure 37B:
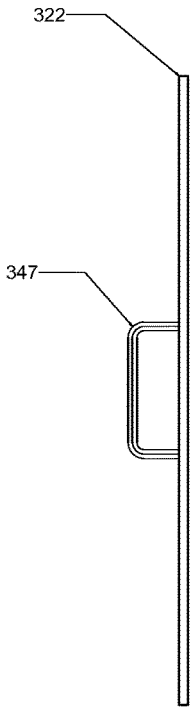
FIG. 37B is a side view of the cover assembly for the waterproof pump enclosure according to the present invention.
Figure 38A:
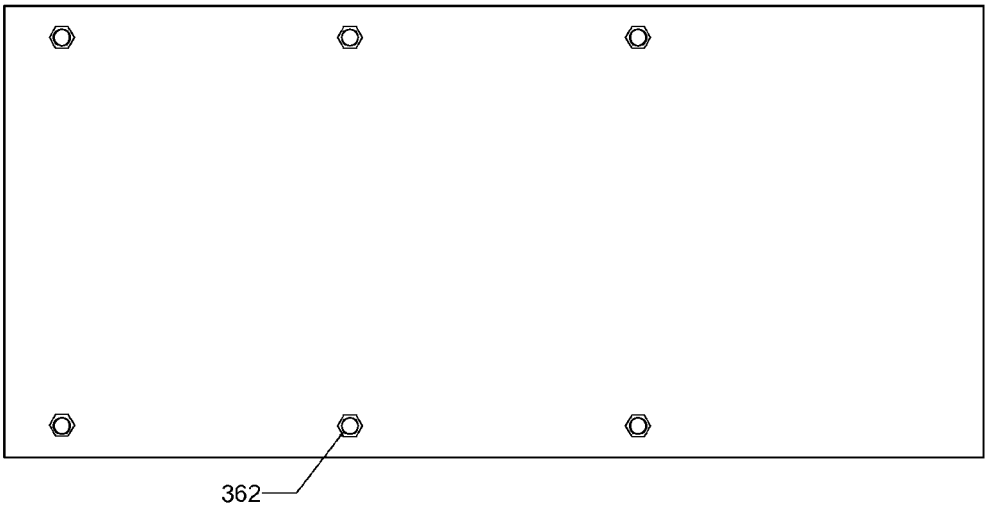
FIG. 38A is a top plan view of a mounting plate for the waterproof pump enclosure according to the present invention.
Figure 38B:
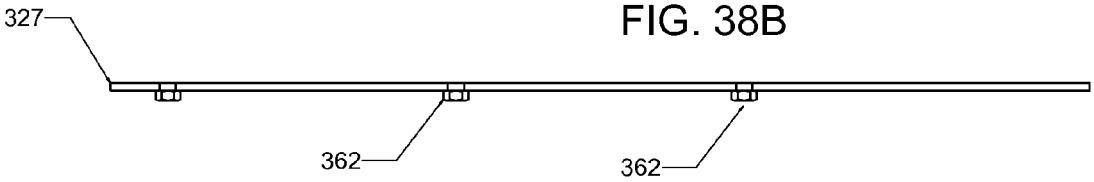
FIG. 38B is a side view of the mounting plate for the waterproof pump enclosure according to the present invention.
Figure 39A:
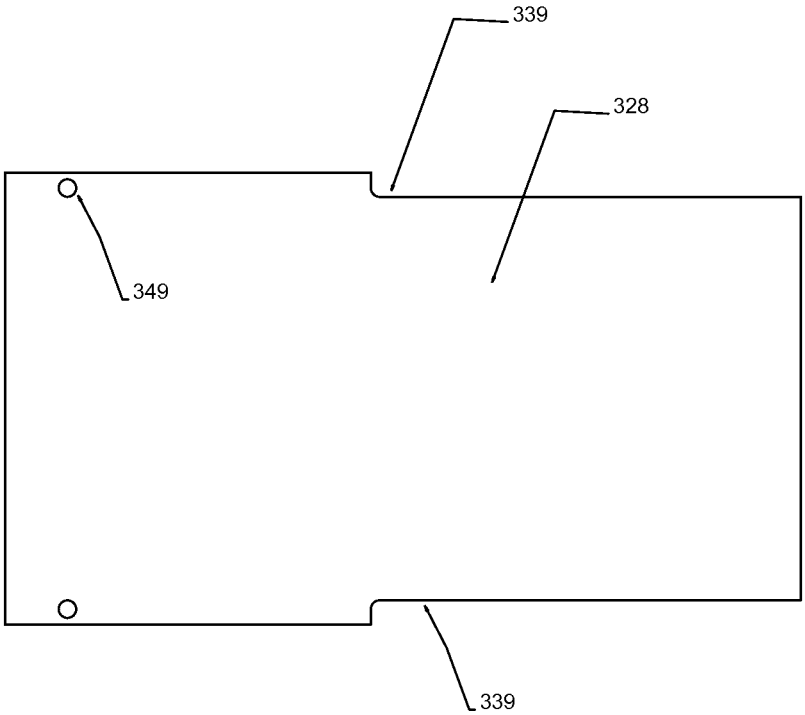
FIG. 39A is a top plan view of a sliding plate for the waterproof pump enclosure according to the present invention.
Figure 39B:
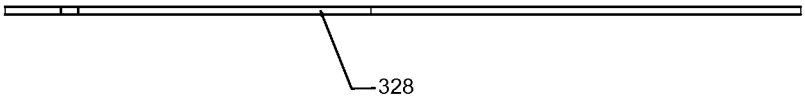
FIG. 39B is a side view of the sliding plate for the waterproof pump enclosure according to the present invention.

Referring now to FIGS. 32-36, 37A-37B and 45A-45B, the pump enclosure 310 may also include a cover plate 322 that is configured to be secured to the flange 340 by one or more suitable fasteners, such as a bolt 353 and nut 354 combination. It is understood that any suitable fastener may be used to secure the cover plate 322 to the flange 340, but it is preferable that the fasteners are capable of releasing the cover plate 322 from the flange 340 through appropriate removable mechanisms and/or tools so that access to the interior of the pump enclosure 310 can be gained without substantial effort or difficulty. While a bolt 353 and nut 354 combination is provided as an example of a suitable fastener, it is understood that such combination is merely exemplary and that the fasteners may also include screws that engage with threads that may be present within the bores 341 of the flange 340. A gasket 352, as shown in greater detail in FIGS. 45A-45B, for example a gasket made from neoprene rubber, may be placed between the cover plate 322 and flange 340 so as to provide a water tight connection between the cover plate 322 and the flange 340 so as to seal the pump enclosure 310. The gasket 352 may include one or more bores 355 positioned around the circumference of the gasket 352 so that the fasteners 353, 354 may be inserted through the cover plate 322, gasket 352 and flange 340. Preferably, the bores 355 formed through the gasket 352 are positioned for alignment with the bores 341 formed in the flange 340, and preferably the same number of bores 341 formed in the flange 340 are present in the gasket 352. However, it is understood that additional bores 355 may be formed in the gasket 352 than those formed in the flange 340 so that alignment and installation of the gasket 352 on the flange 340 may be facilitated. Referring now more particularly to FIGS. 37A and 37B, cover plate 322 may include one or more handles 347 to facilitate removal and installation of the cover plate 322, and may also include one or more bores 325 positioned around the circumference of the cover plate 322 so that the fasteners 353, 354 may be inserted through the cover plate 322, gasket 353 and flange 340. The handles 347 may be formed from substantially U-shaped or C-shaped rod or bar, and securely affixed to the cover plate 322. The one or more bores 325 are positioned around the cover plate 322 so that when the cover plate 322 is applied to the flange 340 the bores 341 on the flange 340 substantially align with the bores 325 on the cover plate 322 so that the fasteners 353, 354 can secure the cover plate 322 to the flange 340. It is understood that the bores 325 on the cover plate 322 may be the same number as the bores 341 on the flange 340 or may be greater or lesser in number depending upon the desired application.

Figure 43B:
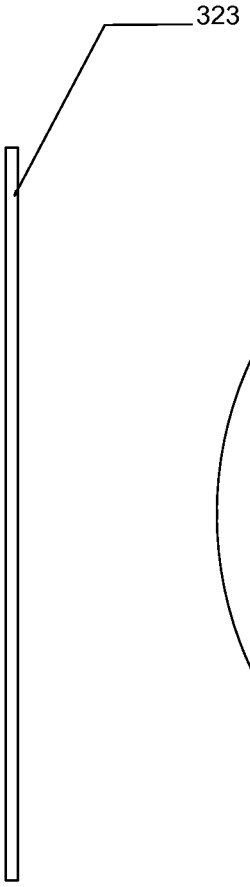
FIG. 43B is a side view of the exemplary back cover plate for the waterproof pump enclosure according to the present invention.
Figure 43A:
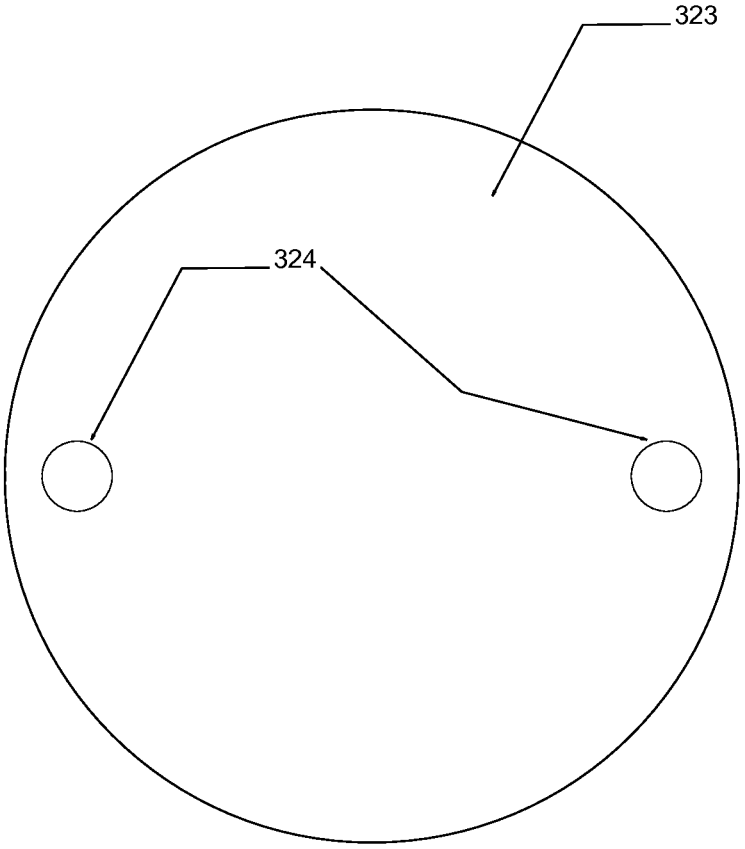
FIG. 43A is a front view of an exemplary back cover plate for the waterproof pump enclosure according to the present invention.

Referring now to FIGS. 32-36 and 43A-43B, the pump enclosure 310 may also include a welded rear cover 323 positioned on an end of the body pipe 319 opposite the cover plate 322 and flange 340. The rear cover 323 may be welded onto the body pipe 319 to form a substantially watertight and/or waterproof seal, and it is understood that additional waterproofing may be applied to the joint between the rear cover 323 and the body pipe 319 in order to ensure that there is a watertight and/or waterproof seal so that the interior region of the pump enclosure 310 is at least substantially leak proof. As shown in FIG. 43A, the rear cover 323 may include one or more openings 324 that are configured and dimensioned to allow connections between the interior region of the pump enclosure 310 and items on the exterior of the pump enclosure.

Referring now to FIGS. 32-36, 38A-38B and 39A-39B, the pump enclosure 310 is configured to contain a pump and motor assembly 350, such as model numbers LO-201 or LO-202 available from Preferred Utilities Manufacturing Corp. of Danbury, Conn. The pump and motor assembly 350 may be mounted within the pump enclosure 310 on a mounting plate 327 that is secured to the body pipe 319. The mounting plate 327 may be secured to the body pipe 319 through welds and/or adhesives, or may be attached to the body pipe 319 by suitable brackets (not shown). The mounting plate 327 may be installed in the interior region of the pump enclosure 310 so that it forms a chord of the circle formed by the body pipe 319. It is preferable that the mounting plate 327 is installed in the body pipe 319 so that the mounting plate 327 is substantially level relative to a surface on which the pump enclosure 310 may be installed. As shown in greater detail in FIGS. 38A and 38B, the mounting plate 327 may include one or more captive nuts 362, that may be used to secure fasteners to the mounting plate 327. While pump and motor assembly 350 may be attached directly to the mounting plate 327, the pump and motor assembly 350 may alternatively be attached to a sliding plate 328 that is movable relative to the mounting plate 327 so that the pump and motor assembly 350 may be at least partially removed from the pump enclosure 310 for service and/or maintenance. As shown in greater detail in FIGS. 39A and 39B, the sliding plate 328 may include side notches 339 in which the width of the sliding plate 328 is decreased over at least a portion of the sliding plate 328. In this manner, the sliding plate 328 can be retained between fasteners 356 installed into the captive nuts 362 of the mounting plate 327 in order to keep the sliding plate 328 in the appropriate alignment within the interior region of the pump enclosure 310. The sliding plate 328 may also include one or more bores 349, so that the fasteners 356 can be used to secure the sliding plate 328 to the mounting plate 327 when it is not desirable for the sliding plate 328 to move relative to the mounting plate 327. When it is desired to move the sliding plate 328 relative to the mounting plate 327, for example for service and/or maintenance of the pump and motor assembly 350, the fasteners 356 installed through the bores 349 can be removed so that the sliding plate 328 is movable relative to the mounting plate 327. Suitable lubricants and/or gliding mechanisms (not shown), e.g., Teflon or nylon strips, can be installed between the sliding plate 328 and the mounting plate 327 to ensure smooth operation of the sliding plate 328 relative to the mounting plate 327.

Referring now to FIG. 3234 the pump enclosure 310 may also include a leak detector switch (not shown) that is configured to detect the presence of oil and/or water within the pump enclosure 310, and provide an indication as to their presence. The pump enclosure 310 may also include a disconnect switch 334 mounted to a disconnect bracket 342. The pump enclosure 310 may further include a supply inlet 314, and a discharge outlet 317 that provide passageways through the pump enclosure 310, but also provide for watertight connections between the flexible hose 312, which may be braided stainless steel over a Teflon core with carbon steel fittings, and an oil supply and an oil discharge lines (not shown). The supple inlet 314 and the discharge outlet 317 may be inserted through the openings 324 in the rear cover 323, or any other suitable openings made in the pump enclosure 310. The flexible hose 312 may be connected to the pump and motor assembly 350 by one or more nipples 345 and unions 332 in order to provide a substantially leak tight connection between the supply inlet 314, discharge outlet 317 and the pump and motor assembly 350. The pump enclosure 310 may also include one or more nipples 321 connected to the body pipe 319 and attached to the body pipe 319 so as to provide water tight connections between electrical conduit 320 running to the pump enclosure 310. The electrical conduit 320 may contain wiring for distributing power to the pump and motor assembly 350, as well as wiring for the leak sensor (not shown). The pump enclosure 310 may further include a lifting lug 336 attached to the body pipe 319 in order to facilitate installation of the pump enclosure 310.

Referring now to FIGS. 32-36 and 42A-42C, the pump enclosure 310 may also include one or more mounting brackets 329 attached to an underside of the body pipe 319. It is understood that underside is merely used for reference, and the positioning of the mounting brackets 329 are not limited to any particular location on the pump enclosure 310. However, it is preferable that the mounting brackets 329 are positioned substantially parallel with the mounting plate 327 so that the mounting plate 327 may be substantially level with the surface on which the pump enclosure 310 may be installed. As shown in greater detail in FIGS. 42A-42C, the mounting brackets 329 include a cutout portion 365 to provide cradle for the body pipe 319 to rest in on the mounting bracket 329. It is understood that the cutout portion 365 should have substantially the same radius as the body pipe 319 so that as much of the body pipe 319 will be in contact with the mounting bracket 329 as possible. It is further understood that the body pipe 319 may be affixed to the mounting brackets 329 through any suitable welding and/or adhesive mechanism. The mounting brackets 329 may also include one or more bores 367 through which fasteners (not shown), such as bolts, screws, nails, pins, stakes, any combination thereof or the like may be inserted in order to attach the pump enclosure 310 to the surface on which it will be mounted.

It will thus be seen that the objects set forth above, among those made apparent from the preceding description, are efficiently attained and, since certain changes may be made in the above article without departing from the scope of this invention, it is intended that all matter contained in this disclosure or shown in the accompanying drawings, shall be interpreted, as illustrative and not in a limiting sense. It is to be understood that all of the present figures, and the accompanying narrative discussions of corresponding embodiments, do not purport to be completely rigorous treatments of the invention under consideration. It is to be understood that the above-described arrangements are only illustrative of the application of the principles of the present invention. Numerous modifications and alternative arrangements may be devised by those skilled in the art without departing from the scope of the present invention.

What is claimed is:

1. A submersible and waterproof enclosure, comprising:

a body having a first end and a second end, and an interior region defined between the first end and the second end;

a plate covering the second end of the body and forming a seal therewith;

a cover configured for removable attachment to the first end of the body;

an inlet opening extending through the body or the plate and configured to allow an inflow of a liquid fuel into the interior region from a source of the liquid fuel;

a discharge opening extending through the body or the plate and configured to allow an outflow of the liquid fuel from the interior region to a drain of the liquid fuel;

a pump and motor assembly operatively connected to the inlet opening and the discharge opening and configured to effect a flow of the liquid fuel from the source to the drain, at least one nipple extending through the body or the plate and affixed to the body or the plate to form a leak-tight seal around a junction between the nipple and the body or the plate;

a mounting plate affixed to the body and positioned within the interior region of the body thereby defining a substantially horizontal surface therein; and a sliding plate operatively coupled to an upper surface of the mounting plate and configured for substantially horizontal movement between a first position and a second position, the pump and motor assembly operatively connected to an upper surface of the sliding plate, wherein in the first position the sliding plate and the pump and motor assembly is completely within the interior region of the body and in the second position the sliding plate and the pump and motor assembly is at least partially extended outside the interior region of the body, wherein the body has a substantially horizontal center axis;

wherein the body and plate with the cover attached enclose the interior region of the body and allow the interior region of the body to remain substantially free of water when the enclosure is totally submerged under water;

wherein said nipple allows at least one insulated electrical wire from an external control source to supply power and control to the interior region of the body without allowing water to enter the interior region of the body.

2. The enclosure according to claim 1, wherein the source of the liquid fuel is a tank, container, reservoir or any combination thereof.

3. The enclosure according to claim 1, wherein the drain of the liquid fuel is a boiler, generator, emergency power generator or any combination thereof.

4. The enclosure according to claim 1, further comprising at least one support bracket operatively coupled to the body and configured to support the enclosure and securely attach the enclosure to a surface.

5. The enclosure as in claim 1, further comprising at least one potting eye connected to the nipple, said potting eye allows electrical wiring to run through and allows injection of a gel that fills the void inside the potting eye and subsequently solidifies to provide a seal against water outside the enclosure from entering the interior region of the enclosure.

6. The enclosure as in claim 1, further comprising at least one electrical conduit having two ends, a first end sealingly connected to the nipple, and a second end extending above an anticipated flood water level, said electrical conduit and the nipple allow electrical wiring to run from an external source to the interior region of the enclosure and provide a seal against water outside the enclosure from entering the interior region of the enclosure.

7. The enclosure as in claim 1, wherein the body of the enclosure is substantially cylindrical in shape.

8. The enclosure as in claim 7, wherein the body of the enclosure and the mounting plate form a space under the mounting plate, said space allows the collection of water in the rare events wherein a small amount of water leaks into the interior space of the enclosure.

9. The enclosure according to claim 1, further comprising an inlet hose positioned within the interior region of the body and connected to the inlet opening, and a discharge hose positioned within the interior region of the body and connected to the discharge opening.

10. The enclosure according to claim 9, wherein the inlet hose and the discharge hose are comprised of substantially flexible material.

11. The enclosure according to claim 1, further comprising a flange positioned around a periphery of the first end of the body and configured to provide a mounting surface on which the cover is attached to the first end of the body.

12. The enclosure according to claim 11, further comprising at least one fastening device configured to removably attach the cover to the mounting surface provided by the flange.

13. The enclosure according to claim 11, further comprising a gasket configured for positioning between the mounting surface and the cover when the cover is attached to the first end of the body, wherein the gasket, cover and flange are configured to provide a substantially leak-tight connection in order to prevent water from entering or exiting the interior region of the body.

* * * * *